US007262000B2

(12) United States Patent
Nariyuki

(10) Patent No.: US 7,262,000 B2
(45) **Date of Patent: *Aug. 28, 2007**

(54) PHOTOTHERMOGRAPHIC MATERIAL AND IMAGE FORMING METHOD FOR THE PHOTOTHERMOGRAPHIC MATERIAL

(75) Inventor: Fumito Nariyuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 163 days.

This patent is subject to a terminal disclaimer.

(21) Appl. No.: 10/687,116

(22) Filed: Oct. 17, 2003

(65) Prior Publication Data

US 2004/0081926 A1 Apr. 29, 2004

(30) Foreign Application Priority Data

Oct. 21, 2002 (JP) ..... 2002-305556
Jan. 21, 2003 (JP) ..... 2003-011903
Mar. 5, 2003 (JP) ..... 2003-058239

(51) Int. Cl.
*G03C 5/16* (2006.01)
*G03C 1/498* (2006.01)

(52) U.S. Cl. ..... 430/350; 430/601; 430/610; 430/945

(58) Field of Classification Search ..... 430/619, 430/350, 945, 601, 610
See application file for complete search history.

(56) References Cited

U.S. PATENT DOCUMENTS 4,173,483 A 11/1979 Habu et al.
4,223,082 A 9/1980 Rosenfeld
4,332,889 A * 6/1982 Siga et al. ..... 430/583
5,817,447 A * 10/1998 Yip ..... 430/363
5,952,167 A * 9/1999 Okada et al. ..... 430/619
5,958,668 A * 9/1999 Matsumoto et al. ..... 430/619
6,143,488 A * 11/2000 Uytterhoeven et al. ..... 430/619
6,146,822 A 11/2000 Asanuma et al.
6,165,705 A 12/2000 Dankosh et al.
6,472,131 B1 * 10/2002 Whitcomb ..... 430/350
7,060,423 B2 6/2006 Yamane et al.
7,105,282 B2 * 9/2006 Yamane et al. ..... 430/350
2002/0123016 A1 * 9/2002 Hirabayashi ..... 430/620
2003/0118953 A1 * 6/2003 Yamane et al. ..... 430/350
2003/0207216 A1 * 11/2003 Fukui et al. ..... 430/350
2003/0232288 A1 * 12/2003 Oka et al. ..... 430/350
2004/0038156 A1 * 2/2004 Oyamada et al. ..... 430/350
2004/0058281 A1 * 3/2004 Yamane et al. ..... 430/350

FOREIGN PATENT DOCUMENTS

EP 0071488 2/1983
EP 0497362 8/1992
EP 1026545 8/2000
EP 1096310 A2 * 2/2001
JP B 2785129 4/1990
JP A 08-297345 11/1996
JP 2000-206653 A 7/2000
JP A 2000-305213 11/2000
JP A 2001-100358 4/2001
WO WO97/48014 12/1997
WO WO97/48015 12/1997

* cited by examiner

*Primary Examiner*—Thorl Chea
(74) *Attorney, Agent, or Firm*—Margaret A. Burke; Sheldon J. Moss

(57) ABSTRACT

A photothermographic material, comprising at least a photosensitive silver halide, a non-photosensitive organic silver salt, a reducing agent and a binder, wherein a total silver iodide content of the photosensitive silver halide is 40% by mole or more and thermal development is started within 60 sec after exposure.

15 Claims, 3 Drawing Sheets

PHOTOTHERMOGRAPHIC MATERIAL AND IMAGE FORMING METHOD FOR THE PHOTOTHERMOGRAPHIC MATERIAL

CROSS-REFERENCE TO RELATED APPLICATION

This application claims priority under 35 USC 119 from Japanese Patent Application Nos. 2002-305556, 2003-11903, and 2003-58239, the disclosures of which are incorporated by reference herein.

BACKGROUND OF THE INVENTION

1. Field of the Invention

The present invention relates to photothermographic material and a method of forming an image using the photothermographic material.

2. Description of the Related Art

Recently, in the field of films for medical imaging, there is a strong demand for reducing the volume of waste processing liquid from the viewpoint of environmental preservation and economy of space. There have been demands for technologies relating to use of a photothermographic material as a film for medical imaging and a film for graphic arts. In particular, there is a demand for a photothermographic material that can be efficiently exposed by a laser image setter or a laser imager, and can provide black-toned images with high resolution and sharpness. Such a photothermographic material can provide users with a more simple and ecological thermal developing system without the use of liquid processing chemicals.

Although there are similar demands in the field of general image forming materials, high image quality (i.e., excellent sharpness and fine graininess) is particularly required for images used in medical imaging where high image quality of excellent sharpness and granularity are necessary. Further, images with blue-black tones are preferred from the perspective of facilitating diagnosis. Various types of hard copy systems using pigment or dye, such as an inkjet printer and an electrophotograph system, are commonly used as a general image forming system. However none of these is satisfactory as an output system for medical images.

In general, thermal image forming systems using organic silver salts are described in U.S. Pat. Nos. 3,152,904 and 3,457,075 and on pages 279 to 291, Chapter 9, "Thermally Processed Silver Systems," written by D. Klosterboer, in (Imaging Processes and Materials) Neblette, 8th edition, compiled by J. Sturge, V. Walworth and A. Shepp (1989), the disclosures of which is incorporated herein by reference.

A photothermographic material typically includes a photosensitive layer in which a photocatalyst (e.g., silver halide) of a catalytically active amount, a reducing agent, reducible silver salt (e.g., organic silver salt) and a toner for controlling the tone of a developed silver image as needed are dispersed in the matrix of a binder. After an image is exposed thereon, the photothermographic material is heated to a high temperature (e.g., 80° C. or above) to cause an oxidation-reduction reaction between a silver halide or a reducible silver salt (which acts as an oxidizing agent) and a reducing agent, thus providing a black silver image. The oxidation-reduction reaction is accelerated by the catalytic action of a latent image of the exposed silver halide. As a result the black silver image is formed in the exposed region (see U.S. Pat. No. 2,910,377 and Japanese Patent Application Publication (JP-B) No. 43-4924). Further, Fuji medical dry imager FM-DP L is an example of a practical medical image forming system using a photothermographic material that has been marketed.

In production of a thermographic system using an organic silver salt, two methods are available: in one method, a solvent coating is adopted and in the other method a coating liquid containing polymer fine particles as a main binder in an aqueous dispersion is applied and dried. In the latter method, since no necessity arises for a process of solvent recovery or the like, a production facility is simple and the method is advantageous for mass production.

Since such a thermographic system using an organic silver salt has no fixing step, there has been a considerable problem in image preservability after development, particularly with respect to degradation of a print-out when exposed to light. As means for improving the print-out, a method in which silver iodide formed through conversion of an organic silver salt is employed is disclosed in U.S. Pat. No. 6,143,488 and EP No. 0922995. In the method, such as described here, in which an organic silver salt is converted with iodine, however, a sufficient sensitivity cannot be obtained, which has led to difficulty in incorporation into an actual system.

As to other photosensitive materials using silver iodide, description thereof is given in WO (Laid-Open) Nos. 97-48014 and 97-48015; U.S. Pat. No. 6,165,705; Japanese Patent Application Laid-Open (JP-A) No. 8-297345; Japanese Patent No. 2785129 and others, in any of which neither a sufficient sensitivity nor a sufficient fog level is achieved, leading to a poor laser exposure photosensitive material which is not suitable for practical use. Development of a method has been awaited in which a silver halide rich in silver iodide content is effectively used to full performance.

JP-A No. 2000-305213 discloses an image forming method using a blue to ultraviolet laser beam and a photosensitive material therefor. However, no silver iodide is employed, resulting in insufficient sensitivity.

It has been understood from research conducted by the inventors of the invention that a photosensitive material of a high sensitivity and a high image quality is obtained by use of silver iodide in a system using a blue to ultraviolet laser beam.

Though a photosensitive material using silver halide with a high silver iodide content ensures practical sensitivity, the sensitivity thereof is still insufficient as compared with a level of expectation based on exposure being conducted at an absorption edge unique to silver iodide at which a high absorbance is realized.

That is, while it has been desired to achieve a full performance of a silver halide with a high silver iodide content since it is excellent in suppression of fogging and print-out, the current state of the art remains of insufficient sensitivity.

SUMMARY OF THE INVENTION

An object of the present invention is to provide a photothermographic material using a silver halide with a high content of silver iodide and having sufficient sensitivity under irradiation with a blue to violet laser beam.

An aspect of the present invention is to provide a photothermographic material comprising at least a photosensitive silver halide, a non-photosensitive organic silver salt, a reducing agent and a binder, wherein a total silver iodide content of the photosensitive silver halide is 40% by mol or more and thermal development is started within 60 seconds after exposure.

DETAILED DESCRIPTION OF THE PRESENT INVENTION

1. Photothermographic Material

Figure 1:
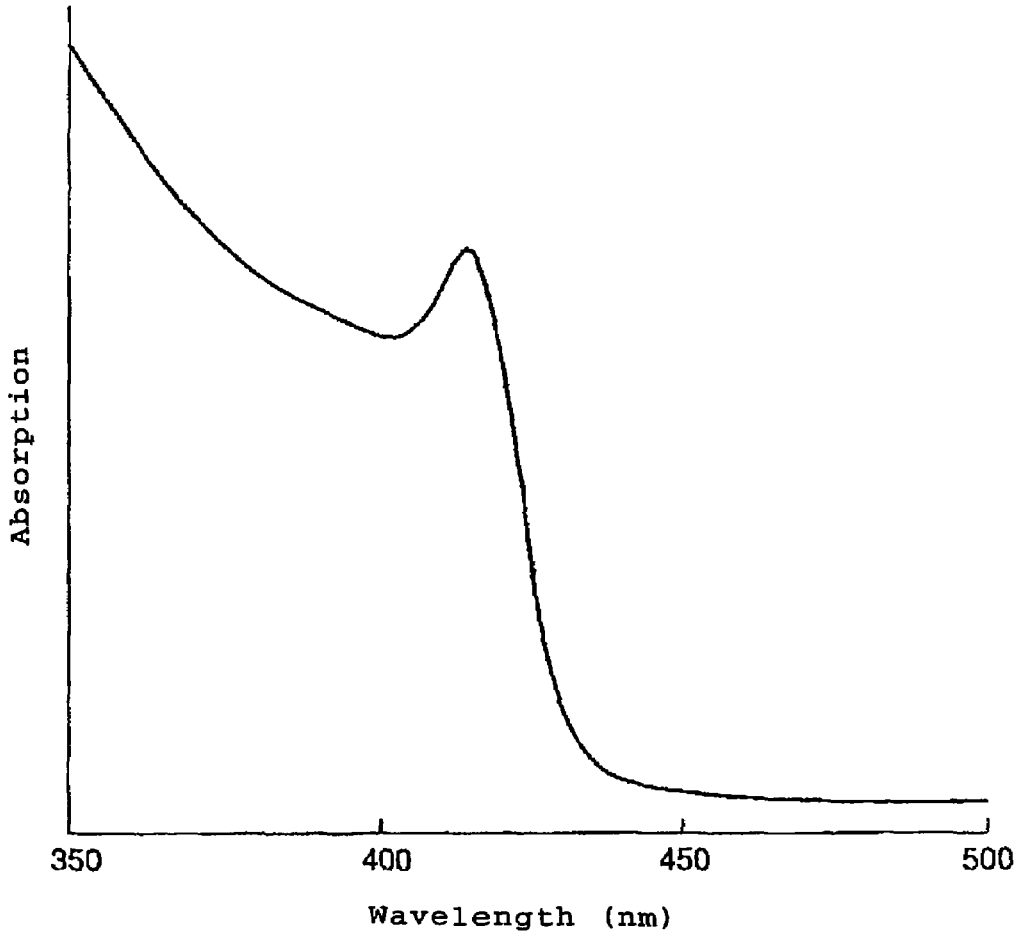
FIG. 1 is a diagram of light absorption of a silver halide emulsion preferably used in the present invention.

A photothermographic material of the invention is characterized by that the photothermographic material includes at least a photosensitive silver halide, a non-photosensitive organic silver salt, a reducing agent and a binder on a support, wherein a total silver iodide content of the photosensitive silver halide is 40% by mole or more and thermal development is started within 60 sec after exposure.

A photothermographic material having the above feature can realize a photothermographic material having a sufficient sensitivity as high as expectation from the use of a photosensitive silver halide, which is a silver halide with a high silver iodide content, under irradiation of blue to ultraviolet laser beam.

Detailed description will be given of individual constituents in a photothermographic material of the invention below.

1-1. Photosensitive Silver Halide

A photosensitive silver halide employed in the invention is characterized by that a total silver iodide content is 40% by mole or more. A total silver iodide content of the silver halide is more preferably 60% by mole or more and still more preferably 80% by mole or more and most preferably 90% by mole or more. In this way, the higher the solver iodide content, the effect of the invention is more clearly exerted.

A part of a silver halide of the invention preferably has a layer absorbing light through direct transition. It has been well known that in an exposure wavelength in the range of from 350 nm to 450 nm of the invention, the direct transition absorption can be realized in the presence of a high silver iodide structure having a wurtzite structure of a hexagonal system or a zinc blend structure of a cubic crystal system. A silver halide having such an absorption structure, however, is generally of a low sensitivity and therefore, of a low value by the photographic industrial standard.

According to research conducted by the inventors, in a photothermographic material with a high silver iodide content having a non-photosensitive organic silver salt and a reducing agent, high sensitivity and high sharpness can be achieved by exposure at a high intensity (1 $mW/mm^2$ or higher) for a short time (1 sec or less, preferably $10^{-2}$ sec or less and more preferably $10^{-4}$ sec or less).

A silver halide of the invention preferably exhibits direct transition absorption originating from a silver iodide crystal structure at wavelengths ranging from 350 nm to 450 nm. Whether or not a silver halide has optical absorption caused by direct transition is easily discriminated by whether there is found exciton absorption caused by direct transition in the vicinity of the range of from 400 nm to 430 nm.

In FIG. 1, there is shown optical absorption of a silver iodide emulsion preferably used in the invention. It is found that there is observed absorption in the vicinity of 420 nm caused by an exciton of silver iodide at a high content.

Such a high silver iodide phase of a direct transition optical absorption type is non-problematically present alone, while being preferably present in contact with a silver halide exhibiting indirect transition absorption in a wavelength region of from 350 nm to 450 nm such as a silver bromide emulsion, a silver chloride emulsion, a silver iodobromide emulsion or a silver iodochloride emulsion, or a mixed crystal thereof.

While such a silver halide phase absorbing light through direct transition generally exhibits strong optical absorption, sensitivity thereof is low as compared with a silver halide phase of an indirect transition type showing only a weak absorption, therefore having resulted in no employment thereof in the industry.

A wavelength for exposure is more preferably in the range of from 370 nm to 430 nm, still more preferably in the range of from 390 nm to 430 nm and yet more preferably in the range of from 390 nm to 420 nm.

According to the invention, the photothermographic material is desirably thermal developed within 60 sec after exposure. The thermal development is conducted more preferably within 30 sec after the exposure and still more preferably within 15 sec after the exposure.

The term "a time from exposure until thermal development" means an average of times from exposure of individual portions in one sheet of a photothermographic material until thermal development is started on the same individual portions.

A photosensitive silver halide of the invention exerts a more preferable characteristic in the range of sizes of from 5 nm to 80 nm. Particularly, in silver halide grains in which there exists a phase having direct transition absorption, a sensitivity is acquired with the grain size of 80 nm or less.

Grain sizes of a photosensitive silver halide is more preferably in the range of from 5 nm to 60 nm and still more preferably in the range of 5 nm to 40 nm and yet more preferably in the range of from 5 nm to 30 nm. The term "a grain size" means a diameter of a sphere having the same volume as a silver halide grain.

A forming method of photosensitive silver halide has been well known in the industry to which the invention pertains and methods can be employed that are disclosed in, for example, Research Disclosure, No. 17029, June, 1978 and U.S. Pat. No. 3,700,458 and to be concrete, a method is employed in which a silver supplying compound and a halogen supplying compound are added into a gelatin solution or another polymer solution to thereby prepare a photosensitive silver halide, followed by mixing with an organic silver salt. Other preferable methods are also disclosed in paragraphs from 0217 to 0224 of JP-A No. 11-119374 and JP-A No. 2000-347335.

While examples of forms of silver halide grains in the invention are cube grains, octahedron grains, dodecahedron grains, tetrahedron grains, flat plate grains, sphere grains, rod grains, potato grains and the like, particularly preferable in the invention are dodecahedron grains and tetrahedron grains. The term "dodecahedron grain" means a grain having planes of (001), {1(−1)0} and {101} and the term "tetrahedron grain" means a grain having planes of (001), {101} and [100]. The {100} expresses a family of crystallographic planes equivalent to a (100) plane.

Silver iodide of the invention can assume any of a β phase or a γ phase contained. The term "β phase" described above means a high silver iodide structure having a wurtzite structure of a hexagonal system and the term "γ phase"

means a high silver iodide structure having a zinc blend structure of a cubic crystal system.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than silver iodide, re-dissolution with fine grain can be prevented and fine silver halide grains with smaller grain size can be prepared.

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together.

A preferred content is within a range from $1\times10^{-9}$ mol to $1\times10^{-3}$ mol per one mol of silver.

The heavy metals, metal complexes and the addition method thereof are described in JP-A No. 7-225449, JP-A 11-65021 (paragraph Nos. 0018 to 0024) and JP-A No. 11-119374 (paragraph Nos. 0227 to 0240).

Metal atoms that can be contained in the silver halide grain used in the invention (for example, $[Fe(CN)_6]^{4-}$), desalting method of a silver halide emulsion and chemical sensitization method are described in JP-A 11-84574 (paragraph Nos. 0046 to 0050), JP-A 11-65021 (paragraph Nos. 0025 to 0031), and JP-A 11-119374 (paragraph Nos. 0242 to 0250).

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 500 to 60,000 is preferably used. The term "molecular weight" as referred herein means a number-average molecular weight, calculated from styrene-reduced gel permeation chromatography (GPC). These low molecular weight gelatins may be used at grain formation or at the time of dispersion after desalting treatment and it is preferably used during grain formation.

The photothermographic material of the invention may also contain various compounds known as super sensitizers in order to increase the inherent sensitivity. The super sensitizers usable in the invention can include those compounds described in EP-A No. 587,338, U.S. Pat. Nos. 3,877,943 and 4,873,184 and JP-A Nos. 5-341432, 11-109547, and 10-111543.

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used.

Particularly, tellurium sensitization is preferred in the invention and compounds described in the literature cited in paragraph No. 0030 in JP-A No. 11-65021 and compounds shown by the general formulae (II), (III), and (IV) in JP-A No. 5-313284 are more preferred.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating. Particularly, it is preferred to be applied after spectral sensitization.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide. There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

The photothermographic material of the invention preferably contains a compound that can be one-electron-oxidized to provide a one-electron oxidation product which releases one or more electrons.

As the compound that can be one-electron-oxidized to provide a one-electron oxidation product, which releases one or more electrons is a compound selected from the following types 1 to 5.

(Type 1) a compound that can be one-electron-oxidized to provide a one-electron oxidation product which further releases at least two electrons, due to when subjected to a subsequent bond cleavage reaction;

(Type 2) a compound that has at least two groups adsorbable to the silver halide and can be one-electron-oxidized to provide a one-electron oxidation product which further releases one electron, due to when subjected to a subsequent bond cleavage reaction;

(Type 3) a compound that can be one-electron-oxidized to provide a one-electron oxidation product, which further releases at least one electron after being subjected to a subsequent bond formation;

(Type 4) a compound that can be one-electron-oxidized to provide a one-electron oxidation product which further releases at least one electron after a subsequent ring cleavage reaction in the molecule; and (Type 5) a compound represented by X-Y, in which X represents a reducing group and Y represents a leaving group, and convertable by one-electron-oxidizing the reducing group to a one-electron oxidation product which can be converted into an X radical by eliminating the leaving group in a subsequent X-Y bond cleavage reaction, one electron being released from the X radical.

Each compound of Types 3 to 5 preferably is a "compound having a sensitizing dye moiety" or a "compound having an adsorbable group to the silver halide". More preferred is a "compound having an adsorbable group to the silver halide". Each compound of Types 1 to 4 more preferably is a "compound having a heterocyclic group containing nitrogen atoms substituted by more than two mercapto groups".

The compound of Type 1 to 5 will be described in detail below.

In the compound of Type 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction. The compound of Type 1 can be one-electron-oxidized to be converted into the one-electron oxidation product, and thereafter can release further two or more electrons, preferably three or more electrons with the bond cleavage reaction.

The compound of Type 1 is preferably represented by any one of general formulae (A), (B), (1), (2) or (3).

General formula (A)

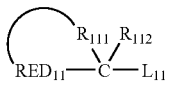

General formula (B)

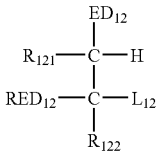

In general formula (A), $RED_{11}$ represents a reducing group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In general formula (B), $RED_{12}$ represents a reducing group that can be one-electron-oxidized, and $L_{12}$ represents a leaving group. $R_{121}$ and $R_{122}$ each represent a hydrogen atom or a substituent. $ED_{12}$ represents an electron-donating group. In the general formula (B), $R_{121}$ and $RED_{12}$, $R_{121}$ and $R_{122}$, and $ED_{12}$ and $RED_{12}$ may bond together to form a ring structure, respectively.

In the compound represented by general formula (A) or (B), the reducing group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

General formula (1)

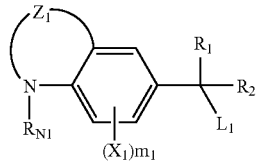

General formula (2)

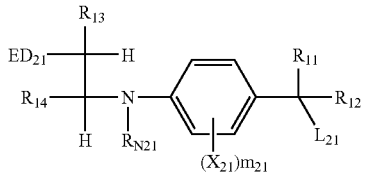

General formula (3)

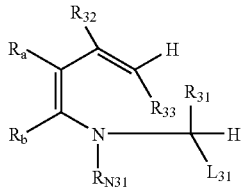

In general formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer of 0 to 3; and $L_1$ represents a leaving group. In general formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent capable of substituting for a hydrogen atom on a benzene ring; $m_{21}$ represents an integer of 0 to 3; and $L_{21}$ represents a leaving group. $R_{N21}$, $R_{13}$, $R_{14}$, $X_{21}$ and $ED_{21}$ may bond to each other to form a ring structure. In general formula (3), $R_{32}$, $R_{33}$ $R_{31}$, $R_{N3}$, $R_a$ and $R_b$ each represents a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by general formula (A) will be described in detail below.

In general formula (A), the reducing group of $RED_{11}$ can be one-electron-oxidized and can bond to after-mentioned $R_{111}$ to form the particular ring structure. Specifically, the reducing group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or non-aromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups. When $RED_{11}$ is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as so-called cyclic amino group like pyrrolidinyl group, an indolinyl group, a piperidinyl group, a piperazinyl group and a morpholino group; etc.

The active methine group is a methine group having two "electron-withdrawing groups", and the "electron-withdrawing group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-withdrawing groups may bond together to form a ring structure.

In general formula (A), specific examples of $L_{11}$ include a carboxy group and salts thereof, silyl groups, a hydrogen atom, triarylboron anions, trialkylstannyl groups, trialkylgermyl groups and a $—CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a $—CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the $—CR_{C1}R_{C2}R_{C3}$ group is the same as a residue provided by removing $L_{11}$ from general formula (A) as a result of selecting each of $R_{C1}$, $R_{C2}$ and $R_{C3}$ as above.

In general formula (A), $L_{11}$ is preferably a carboxy group or a salt thereof, or a hydrogen atom, more preferably a carboxy group or a salt thereof.

When $L_{11}$ represents a hydrogen atom, the compound represented by general formula (A) preferably has a base moiety. After the compound represented by general formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate. When these bases have an anion, the compound of general formula (A) may have a counter cation. Examples of the counter cation include alkaline metal ions, alkaline earth metal ions, heavy metal ions, ammonium ions, phosphonium ions, etc. The base moiety may be at an optional position of the compound represented by general formula (A). The base moiety may be connected to $RED_{11}$, $R_{111}$ or $R_{112}$ in general formula (A), and to a substituent thereon.

In general formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in general formula (A) are ring structures corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have any substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In general formula (B), $RED_{12}$ and $L_{12}$ represent groups having the respective same meanings as $RED_{11}$ and $L_{11}$ in general formula (A), and have the respective same preferable ranges as $RED_{11}$ and $L_{11}$ in general formula (A). $RED_{12}$ is a monovalent group except a case where $RED_{12}$ forms the following ring structure and to be concrete, there are exemplified groups each with a name of a monovalent group described as $RED_{11}$. $RED_{121}$ and $L_{122}$ represent groups having the same meaning as $R_{112}$ in general formula (A), and have the same preferable range as $R_{112}$ in general formula (A). $ED_{12}$ represents an electron-donating group. Each pair of $R_{121}$ and $RED_{12}$; $R_{121}$ and $R_{122}$; or $ED_{12}$ and $RED_{12}$ may form a ring structure by bonding with each other.

An electron-donating group represented by $RED_{12}$ in general formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In general formula (B), $R_{121}$, and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and $RED_{12}$ include, in addition to the examples of the ring structure formed by $R_{111}$ in general formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Below, description will be given of general formulae (1) to (3).

In general formulae (1) to (3), $R_1$, $R_2$, $R_{11}$, $R_{12}$ and $R_{31}$ represent the same meaning as $R_{112}$ of general formula (A) and have the same preferable range as $R_{112}$ of general formula (A). $L_1$, $L_{21}$ and $L_{31}$ independently represents the same leaving groups as the groups shown as concrete examples in description of $L_{11}$ of general formula (A) and also have the same preferable range as $L_{11}$ of general formula (A). The substituents represented by $X_1$ and $X_{21}$ are the same as the examples of substituents of $RED_{11}$ of general formula (A) and have the same preferable range as $RED_{11}$ of general formula (A) $m_1$ and $m_2$ are preferably integers from 0 to 2 and more preferably integers of 0 or 1.

When $R_{N1}$, $R_{N21}$ and $R_{N31}$ each represents a substituent, preferred as a substituent include an alkyl group, an aryl group or a heterocyclic group, and may further have a substituent. Each of $R_{N1}$, $R_{N21}$ and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

The 6-membered ring formed by $Z_1$ in general formula (1) is a nonaromatic heterocycle condensed with the benzene ring in general formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In general formula (2), $ED_{21}$ is the same as $ED_{12}$ in general formula (B) with respect to the meanings and preferred embodiments.

In general formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in general formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In general formula (3), $R_a$ and $R_b$ preferably bond together to form an aromatic ring, particularly a phenyl group.

In general formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-withdrawing group. The electron-withdrawing group is the same as described above, preferably an acyl group, an alkoxycarbonyl group, a carbamoyl group or a cyano group.

The compound of Type 2 will be described below.

According to the compound of Type 2, the "bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Type 2 has two or more, preferably 2 to 6, more preferably 2 to 4, adsorbent groups to the silver halide. The adsorbable group is further preferably a mercapto-substituted, nitrogen-containing, heterocyclic group. The number of the adsorbent groups is preferably 2 to 6, more preferably 2 to 4. The adsorbable group will hereinafter be described.

The compound of Type 2 is preferably represented by the following general formula (C).

General formula (C)

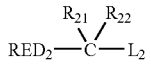

In the compound represented by general formula (C), the reducing group of $RED_2$ is one-electron-oxidized, and thereafter the leaving group of $L_2$ is spontaneously eliminated, thus a C (carbon atom)-$L_2$ bond is cleaved, in the bond cleavage reaction. Further one electron can be released with the bond cleavage reaction.

In general formula (C), $RED_2$ is the same as $RED_{12}$ in general formula (B) with respect to the meanings and preferred embodiments. $L_2$ is the same as $L_{11}$ in general formula (A) with respect to the meanings and preferred embodiments. Incidentally, when $L_2$ is a silyl group, the compound of general formula (C) has two or more mercapto-substituted, nitrogen-containing, heterocyclic groups as the adsorbent groups. $R_{21}$ and $R_{22}$ each represent a hydrogen atom or a substituent, and are the same as $R_{112}$ in general formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Type 3 will be described below.

According to the compound of Type 3, "bond formation" means that a bond of carbon-carbon, carbon-nitrogen, carbon-sulfur, carbon-oxygen, etc. is formed.

It is preferable that the one-electron oxidation product releases one or more electrons after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of type 3 reacts with a reactive group described above coexisting in the same molecule to form a bond and form a radical species having a new ring structure therein. The radical species have a feature to release a second electron directly or in company with elimination of a proton therefrom. One of compounds of type 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of type 3 also include a compound having an ability to further release one or more electron, in an ordinary case two or more electrons directly from a two-electron oxidized product, not by way of a tautomerization reaction.

The compound of Type 3 is preferably represented by the following general formula (D).

$$RED_3\text{-}L_3\text{-}Y_3 \qquad \text{General Formula (D)}$$

In general formula (D), $RED_3$ represents a reducing group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In general formula (D), $RED_3$ has the same meanings as $RED_{12}$ in general formula (B). In general formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, non-aromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(\text{—}OH)\text{—}$, which may be tautomerized into a moiety of $>C_1H\text{—}C_2(=O)\text{—}$. In this case, it is preferred that a substituent on the $C_1$ carbon is an electron-withdrawing group, and as a result, $Y_3$ has a moiety of an active methylene group or an active methine group. The electron-withdrawing group, which can provide such a moiety of an "active methylene group" or an "active methine group", may be the same as above-mentioned electron-withdrawing group on the methine group of the "active methine group".

When $Y_3$ is an organic group containing a carbon-carbon triple bond (for example a ethynyl group) having a substituent, preferred as the substituent is an alkyl group, a phenyl group, an alkoxycarbonyl group, a carbamoyl group, an electron-donating group, etc.

When $Y_3$ is an organic group containing an aromatic group, preferred as the aromatic group are an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, non-aromatic heterocyclic group. Furthermore preferred are an organic group containing a carbon-carbon double bond; a phenyl group having an electron-donating group as a substituent; an indole ring group; and a benzo-condensed, non-aromatic heterocyclic group having an aniline moiety. The carbon-carbon double bond more preferably has at least one electron-donating group as a substituent.

It is also preferred that the reactive group represented by $Y_3$ contains a moiety the same as the reducing group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(═O)—, —$SO_2$—, —SO—, —P(═O)—, or a combination thereof. $R_N$ represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(═O)— group; a —O— group; a —NH— group; —N(alkyl)- groups; and divalent linking groups of combinations thereof.

When a cation radical ($X^{+}$•) provided by oxidizing $RED_3$ or a radical (X•) provided by eliminating a proton therefrom reacts with the reactive group represented by $Y_3$ to form a bond, it is preferable that they form a 3 to 7-membered ring structure containing the linking group represented by $L_3$. Thus, the radical ($X^{+}$• or X•) and the reactive group of Y are preferably connected though 3 to 7 atoms.

Next, the compound of Type 4 will be described below.

The compound of Type 4 has a reducing group-substituted ring structure. After the reducing group is one-electron-oxidized, the compound can release further one or more electrons with a ring structure cleavage reaction. The ring cleavage reaction proceeds as follows.

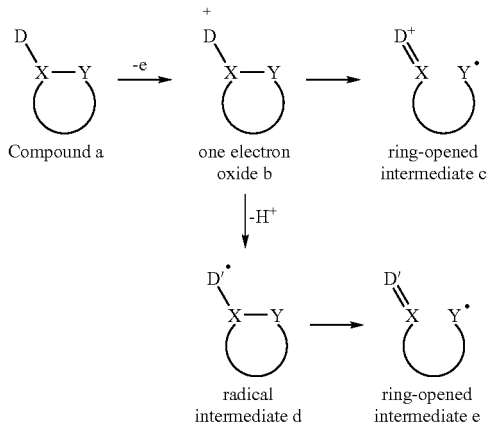

In the formula, compound a is the compound of Type 4. In compound a, D represents a reducing group, and X and Y each represent an atom forming a bond in the ring structure, which is cleaved after the one-electron oxidation. First, compound a is one-electron-oxidized to generate one-electron oxidation product b. Then, the X—Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electron is released form thus-provided Ring-opened intermediate c or e.

The ring structure in the compound of Type 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Type 4 is preferably represented by the following general formula (E) or (F).

General formula (E)

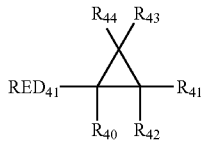

General formula (F)

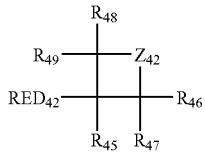

In general formulae (E) and (F), $RED_{41}$ and $RED_{42}$ are the same as $RED_{12}$ in general formula (B) with respect to the meanings and preferred embodiments, respectively. $R_{40}$ to $R_{44}$ and $R_{45}$ to $R_{49}$ each represents a hydrogen atom or a substituent. In general formula (F), $Z_{42}$ represents —$CR_{420}R_{421}$—, —$NR_{423}$-, or —O—. $R_{420}$ and $R_{421}$ each represents a hydrogen atom or a substituent, and $R_{423}$ represents a hydrogen atom, an alkyl group, an aryl group or a heterocyclic group.

In general formulae (E) and (F), each of $R_{40}$ and $R_{45}$ is preferably a hydrogen atom, an alkyl group or an aryl group, more preferably a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-withdrawing group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably —$CR_{420}R_{421}$— or —$NR_{423}$—, more preferably —$NR_{423}$—. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

In the compounds of Types 1 to 4 used in the invention, the adsorbable group to the silver halide is such a group that is directly adsorbed on the silver halide or promotes adsorption of the compound onto the silver halide. Specifically, the adsorbable group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorbable group in the compound of Type 2 is not a sulfide group.

The mercapto group or a salt thereof used as the adsorbable group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. EXAMPLES thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc. The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atom. When the mercapto group forms a salt, a counter ion of the salt may be a cation of an alkaline metal, an alkaline earth metal, a heavy metal, etc. such as $Li^+$, $Na^+$, $K^+Mg^{2+}$, $Ag^+$ and $Zn^{2+}$; an ammonium ion; a heterocyclic group containing a quaternary nitrogen atom; a phosphonium ion; etc.

Further, the mercapto group used as the adsorbable group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. EXAMPLES of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorbable group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferred as the sulfide group are groups having a moiety of alkyl or alkylene-S-alkyl or alkylene.

The cationic group used as the adsorbable group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc.

Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorbable group means a —C≡CH group, in which the hydrogen atom may be substituted.

The adsorbable group may have an optional substituent.

Specific examples of the adsorbable group further include groups described in pages 4 to 7 of a specification of JP-A No. 11-95355.

Preferred as the adsorbable group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorbable group containing two or more mercapto or thione groups as a moiety, such as a dimercapto-substituted, nitrogen-containing, heterocyclic group.

Examples of the adsorbable group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorbable group may be connected to any position of the compound represented by each of general formulae (A) to (F) and (1) to (3). Preferred portions, which the adsorbable group bonds to, are $RED_{11}$, $RED_{12}$, $RED_2$ and $RED_3$ in general formulae (A) to (D), $RED_{41}$, $R_{41}$, $RED_{42}$, and $R_{46}$ to $R_{48}$ in general formulae (E) and (F), and optional portions other than $R_1$, $R_2$, $R_{11}$, $R_{12}$, $R_{31}$, $L_1$, $L_{21}$ and $L_{31}$ in general formulae (1) to (3). Further, more preferred portions are $RED_{11}$ to $RED_{42}$ in general formulae (A) to (F).

The spectral sensitizing dye moiety is a group containing a spectral sensitizing dye chromophore, a residual group provided by removing an optional hydrogen atom or substituent from a spectral sensitizing dye compound. The spectral sensitizing dye moiety may be connected to any position of the compound represented by each of general formulae (A) to (F) and (1) to (3). Preferred portion, which the spectral sensitizing dye moiety bonds to, are $RED_{11}$, $RED_{12}$, $RED_2$ and $RED_3$ in general formulae (A) to (D), $RED_{41}$, $R_{41}$, $RED_{42}$, and $R_{46}$ to $R_{48}$ in general formulae (E) and (F), and optional portions other than $R_1$, $R_2$, $R_{11}$, $R_{12}$, $R_{31}$, $L_1$, $L_{21}$ and $L_{31}$ in general formulae (1) to (3). Further, more preferred portions are $RED_{11}$ to $RED_{42}$ in general formulae (A) to (F). The spectral sensitizing dye is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizing dyes are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The total number of carbon atoms in the compounds of Types 1 to 4 used in the invention is preferably 10 to 60, more preferably 15 to 50, furthermore preferably 18 to 40, particularly preferably 18 to 30.

When a silver halide photosensitive material using the compounds of Types 1 to 4 is exposed, the compound is one-electron-oxidized. After the subsequent reaction, the compound is further oxidized while releasing one electron, or two or more electrons depending on Type. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Types 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Types 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Type 5 will be described.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y with a subsequent X—Y bond cleavage reaction. The X radical can release further one electron. The oxidation reaction of the compound of Type 5 may be represented by the following formula.

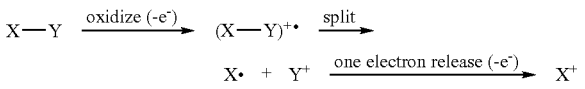

The compound of Type 5 exhibits an oxidation potential of preferably 0 V to 1.4 V, more preferably 0.3 V to 1.0 V. The radical X generated in the formula exhibits an oxidation potential of preferably −0.7 V to −2.0 V, more preferably −0.9 V to −1.6 V.

The compound of Type 5 is preferably represented by the following general formula (G).

General formula (G)

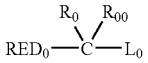

In general formula (G), $RED_0$ represents a reducing group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in general formula (C) with respect to the meanings and preferred embodiments. $R_0$ and $R_{00}$ are the same as $R_{21}$ and $R_{22}$ in general formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in general formula (C). Examples of the ring structure formed by bonding $R_0$ and $R_{00}$ each other include a cyclopentane ring, a tetrahydrofuran ring, etc. In general formula (G), $L_0$ is the same as $L_2$ in general formula (C) with respect to the meanings and preferred embodiments.

The compound represented by general formula (G) preferably has an adsorbable group to the silver halide or a spectrally sensitizing dye moiety. However, the compound does not have two or more adsorbable groups when $L_0$ is a group other than a silyl group. Incidentally, the compound may have two or more sulfide groups as the adsorbent groups, not depending on $L_0$.

The adsorbable group to the silver halide in the compound represented by general formula (G) may be the same as those in the compounds of Types 1 to 4, and further may be the same as all of the compounds and preferred embodiments described as "an adsorbable group to the silver halide" in pages 4 to 7 of a specification of JP-A No. 11-95355.

The spectral sensitizing dye moiety in the compound represented by general formula (G) is the same as in the compounds of Types 1 to 4, and may be the same as all of the compounds and preferred embodiments described as "photoabsorptive group" in pages 7 to 14 of a specification of JP-A No. 11-95355.

Specific examples of the compounds of Types 1 to 5 used in the invention are illustrated below without intention of restricting the scope of the invention.

1

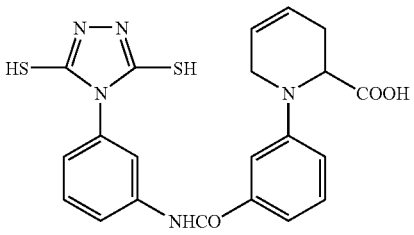

2

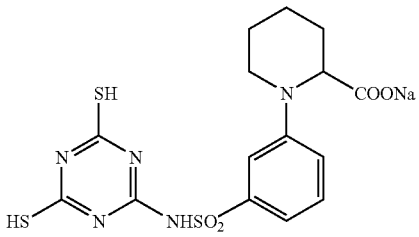

3

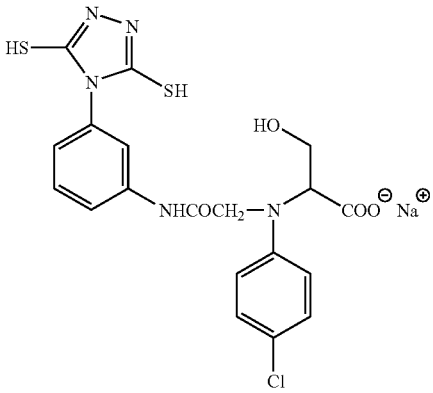

4

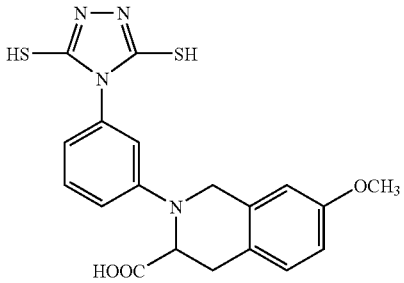

-continued
5
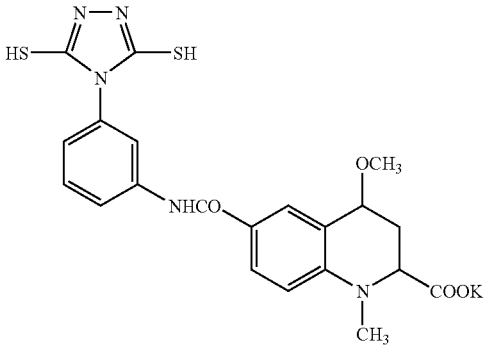
6
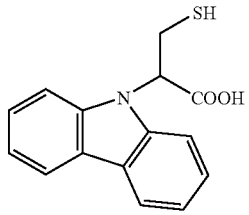
7
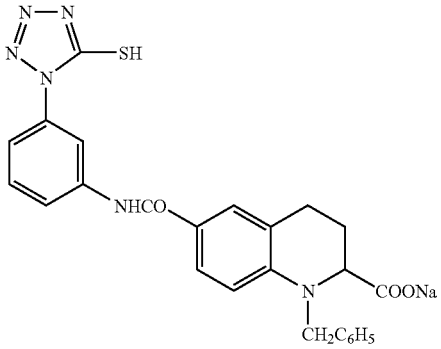
8
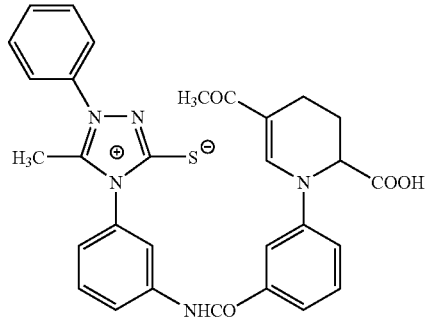
9
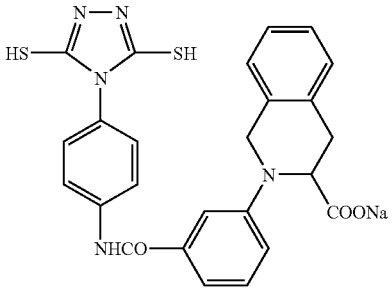
10
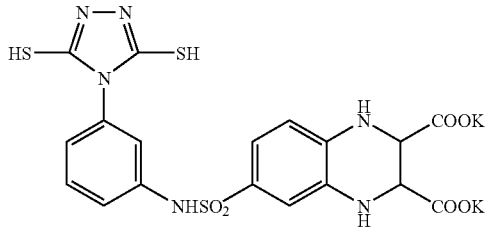
11
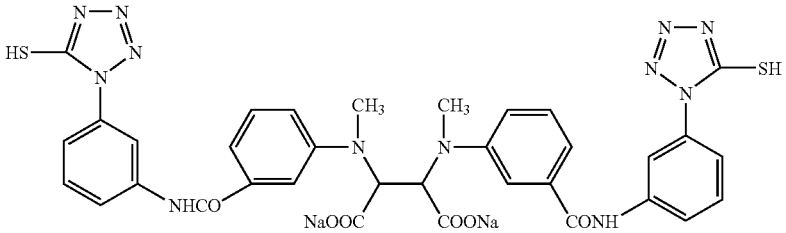
12
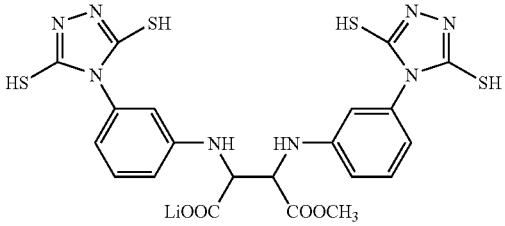
13
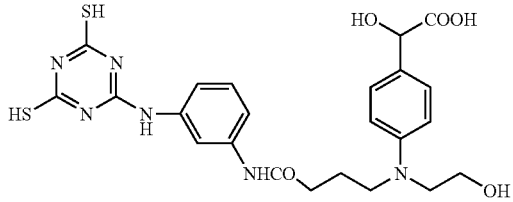

-continued
14
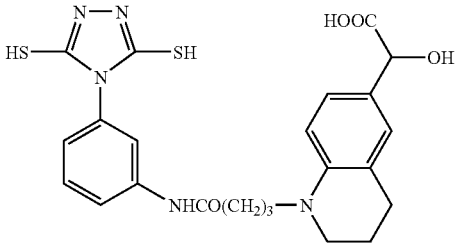
15
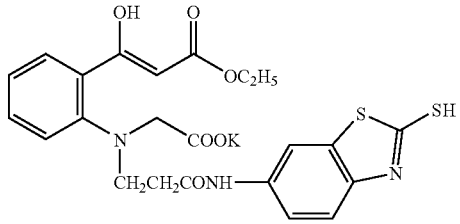
16
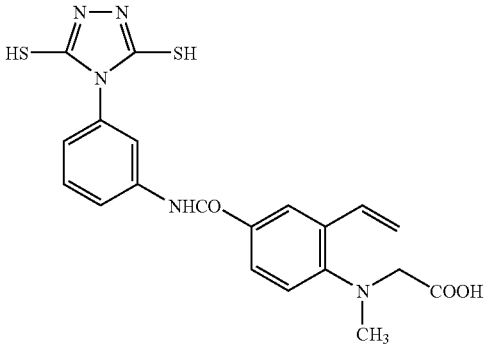
17
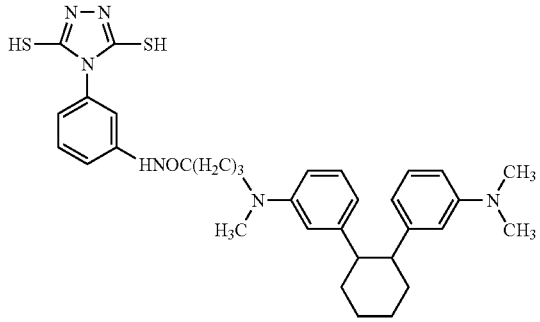
18
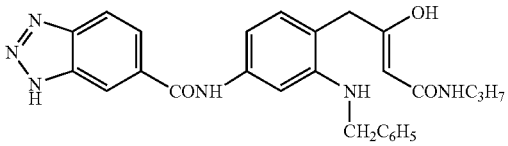
19
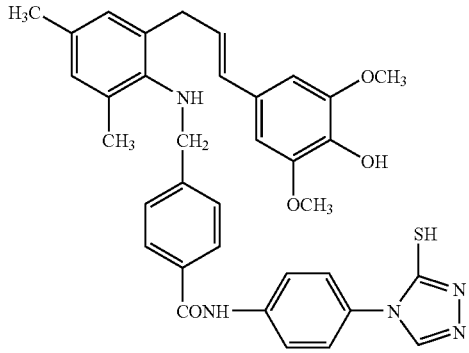
20
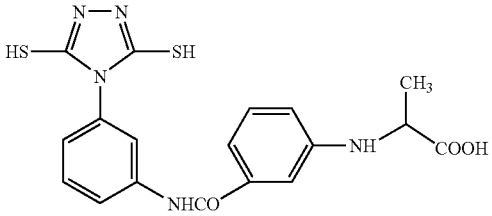
21
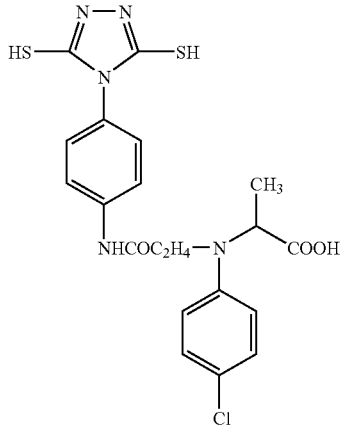

-continued
22
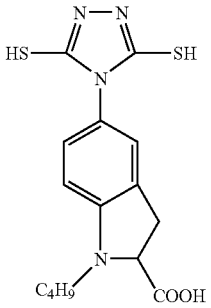
23
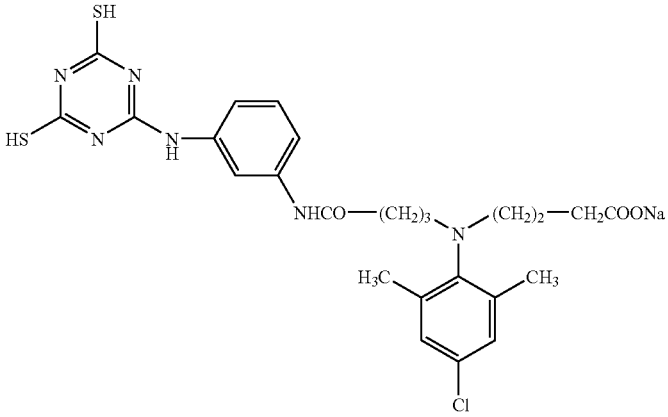
24
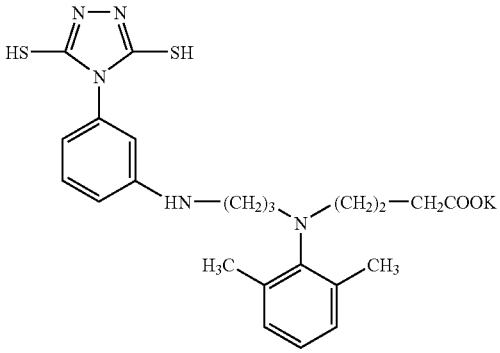
25
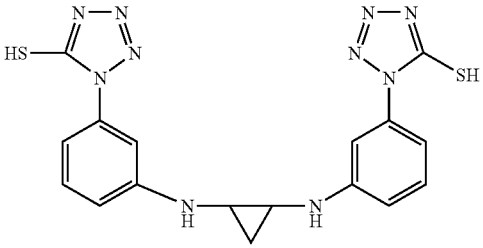
26
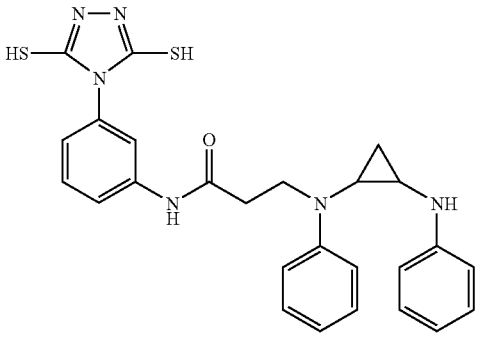
27
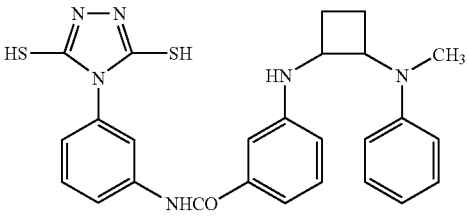

-continued
28
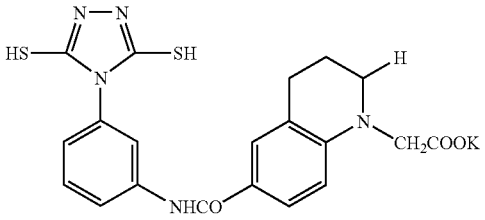
29
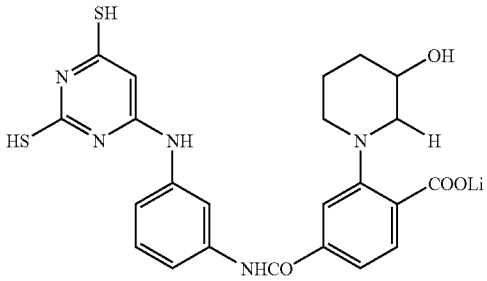
30
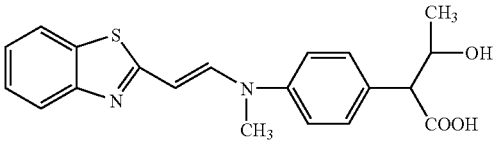
31
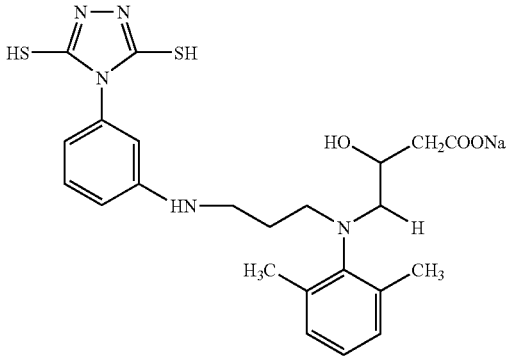
32
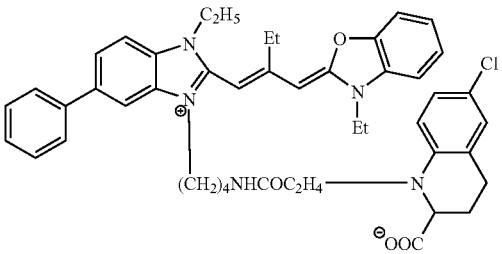
33
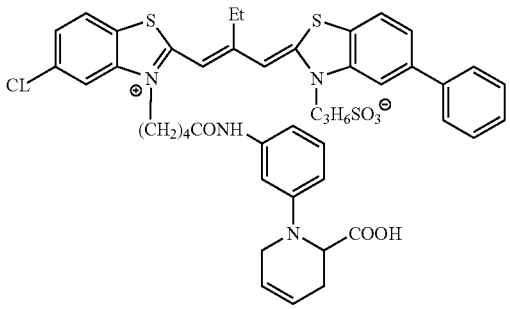
34
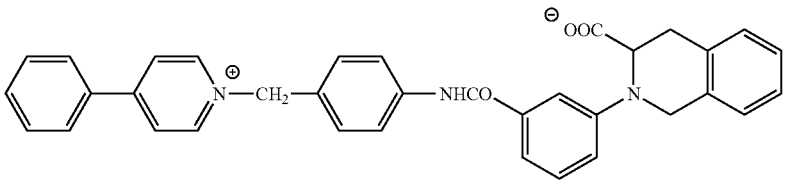
35
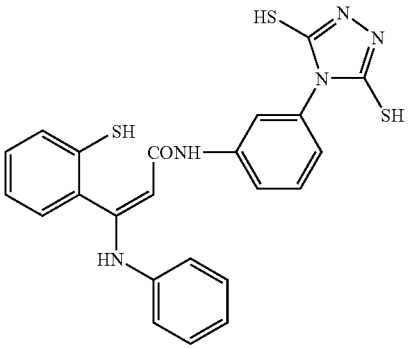
G-1
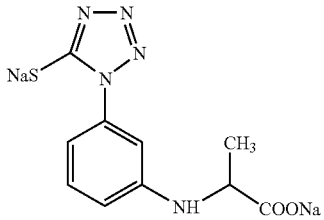

-continued

G-2

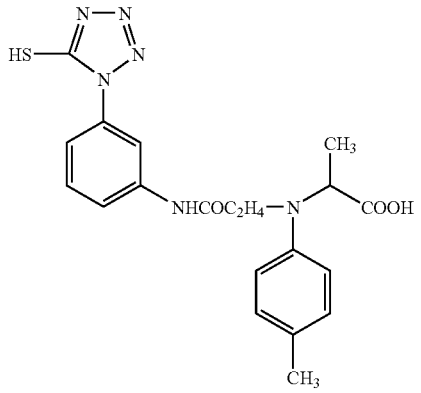

G-3

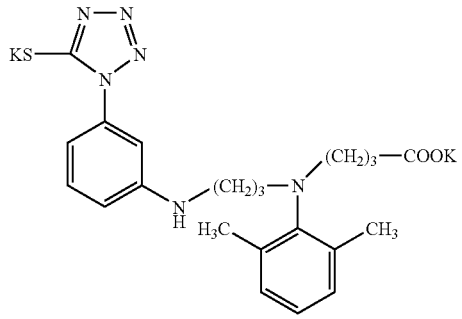

G-4

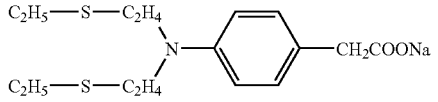

G-5

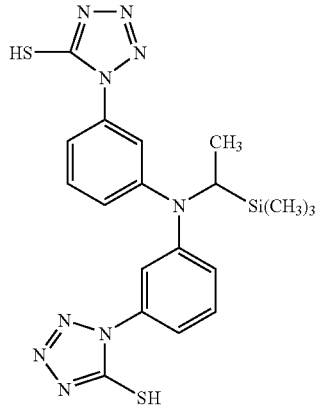

The compounds of Types 1 to 4 used in the invention are the same as compounds described in detail in Japanese Patent Application Nos. 2002-192373, 2002-188537, 2002-188536 and 2001-272137, respectively. The specific examples of the compounds of Types 1 to 4 used in the invention further include compound examples disclosed in the specifications. Synthesis examples of the compounds of Types 1 to 4 used in the invention may be the same as described in the specifications.

Specific examples of the compound represented by general formula (G) further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Types 1 to 5 may be used at any time during preparation of the photosensitive silver halide emulsion and production of the photothermographic material. For example, the compound may be used, in a photosensitive silver halide grains-forming step, in a desalination step, in a chemical sensitization step, before application, etc. The compound may be added in numbers, in these steps. The compound is preferably added, after the photosensitive silver halide grains-forming step and before the desalination step; in the chemical sensitization step (just before the chemical sensitization to immediately after the chemical sensitization); or before the application. The compound is more preferably added, just before the chemical sensitization step to before mixing with the non-photosensitive organic silver salt.

It is preferred that the compound of Types 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Types 1 to 5 used in the invention is preferably added to the image forming layer comprising the photosensitive silver halide and the non-photosensitive organic silver salt. The compound may be added to a surface protective layer, an intermediate layer, as well as the image forming layer comprising the photosensitive silver halide and the non-photosensitive organic silver salt, to be diffused to the image forming layer in the application step. The compound may be added before or after addition of a sensitizing dye. A mol value of the compound per one mol of the silver halide is preferably $1\times10^{-9}$ mol to $5\times10^{-1}$ mol, more preferably $1\times10^{-8}$ mol to $5\times10^{-2}$ mol, in a layer comprising the photosensitive silver halide emulsion.

The photosensitive silver halide emulsion in the photosensitive material used in the invention may be used alone, or two or more kinds of them (for example, those of different average grain sizes, different halogen compositions, different crystal habits and of different conditions for chemical sensitization) may be used together. Gradation can be controlled by using a plural kinds of photosensitive silver halides of different sensitivity.

The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more, when expressed by log E, between each of the emulsions.

The addition amount of the photosensitive silver halide, when expressed by the coating amount of silver per one $m^2$ of the photothermographic material, is preferably from 0.01 $g/m^2$ to 0.6 $g/m^2$, more preferably, 0.02 $g/m^2$ to 0.4 $g/m^2$ and, further preferably, 0.03 $g/m^2$ to 0.3 $g/m^2$. The photosensitive silver halide is used by 0.005 mol to 0.3 mol, preferably, 0.01 mol to 0.2 mol, further preferably, 0.02 mol to 0.15 mol per one mol of the organic silver salt.

The method and condition of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt.

The photosensitive silver halide in the invention is particularly preferably formed under the absence of the non-photosensitive organic silver salt. And, a method of mix two or more kinds of aqueous dispersions of organic silver salts and two or more kinds of aqueous dispersions of photosensitive silver salts upon mixing is used preferably for controlling the photographic properties.

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient.

As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

1-2. Non-photosensitive Organic Silver Salt

The organic silver salt particle according to the invention is relatively stable to light but serves as to supply silver ions and forms silver images when heated to 80° C. or higher under the presence of an exposed potocatalyst (for example, latent image in photosensitive silver halide) and a reducing agent. The organic silver salt may be any organic material containing a source capable of reducing silver ions.

Such non-photosensitive organic silver salt is disclosed, for example, in JP-A Nos. 6-130543, 8-314078, 9-127643, 10-62899 (paragraph Nos. 0048 to 0049), 10-94074, and 10-94075, EP-A No. 0803764A1 (page 18, line 24 to page 19, line 37), EP-A Nos. 962812A1 and 1004930A2, JP-A Nos. 11-349591, 2000-7683, and 2000-72711, and the like.

A silver salt of organic acid, particularly, a silver salt of long chained fatty acid carboxylic acid (number of carbon atoms having 10 to 30, preferably, 15 to 28) is preferable. Preferred examples of the silver salt of the organic acid can include, for example, silver behenate, silver arachidinic acid, silver stearate, silver oleate, silver laurate, silver capronate, silver myristate, silver palmitate and mixtures thereof. Among the organic silver salts, it is preferred to use an organic silver salt with the silver behenate content of 50 mol % or more, more preferably, 80 mol % or more, further preferably, 90 mol % or more.

There is no particular restriction on the shape of the organic silver salt usable in the invention and it may needle-like, bar-like, plate-like or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of 5 or more.

In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 20≧x (average)≧2.0. By the way, needle-like is expressed as 1.5≧x (average)>1.

In the flaky shaped particle, a can be regarded as a thickness of a plate particle having a main plate with b and c being as the sides. a in average is preferably 0.01 μm to 0.23 μm and, more preferably, 0.1 μm to 0.20 μm. c/b in average preferably 1 to 6, more preferably, 1.05 to 4 and, further preferably, 1.1 to 3 and, most preferably, 1.1 to 2.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images.

Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less.

The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Known methods and the like can be applied to manufacturing methods and dispersing methods of an organic acid silver used in the invention. Description of the manufacturing and dispersing methods can be found as reference in the following patent related documents, for example, JP-A No. 10-62899; EP Nos. 0803763 A1, 0962812 A1; JP-A Nos.

11-349591, 2000-7683, 2000-72711, 2001-163827, 2001-163889, 2001-163890 and the like.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, within a range from 1 mol % to 30 mol %, more preferably, within a range from 2 mol % to 20 mol % and, particularly preferably, 3 mol % to 15 mol %.

A method of mix two or more kinds of aqueous dispersions of organic silver salts and two or more kinds of aqueous dispersions of photosensitive silver salts upon mixing is used preferably for controlling the photographic properties.

The organic silver in the invention can be used in any amount, but it is preferably used in the range from 0.1 g/m$^2$ to 5 g/m$^2$, more preferably, 0.3 g/m$^2$ to 3 g/m$^2$, further preferably, 0.5 g/m$^2$ to 2 g/m$^2$ when expressed by the amount of silver.

1-3. Reducing Agent

The photothermographic material of the invention contains a reducing agent for the organic silver salt. The reducing agent may be any substance (preferably, organic substance) capable of reducing silver ions into metallic silver.

Examples of the reducing agent are described in JP-A No. 11-65021 (column Nos. 0043 to 0045) and EP-A 0803764 (p.7, line 34 to p. 18, line 12).

In the invention, a so-called hindered phenolic reducing agent or a bisphenol agent having a substituent at the ortho-position to the phenolic hydroxyl group is preferred and the bisphenolic reducing agent is more preferred. Particularly, the compound represented by the following general formula (R) is preferred.

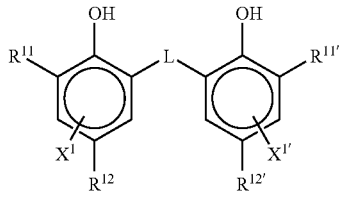

In the general formula (R), $R^{11}$ and $R^{11'}$ each independently represent an alkyl group having 1 to 20 carbon atoms. $R^{12}$ and $R^{12'}$ each independently represents a hydrogen atom or a group capable of substituting for a hydrogen atom on a benzene ring. L represents a —S— group or a —CHR$^{13}$— group. $R^{13}$ represents a hydrogen atom or an alkyl group having 1 to 20 carbon atoms. X and $X^1$ each independently represents a hydrogen atom or a group capable of substituting for a hydrogen atom on a benzene ring.

The general formula (R) is to be described specifically.

$R^{11}$ and $R^{11'}$ each independently represents a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

$R^{12}$ and $R^{12'}$ each independently represents a hydrogen atom or a group capable of substituting for a hydorgen atom on a benzene ring. X and $X^1$ each independently represents a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

L represents a —S— group or a —CHR$^{13}$— group. $R^{13}$ represents a hydrogen atom or an alkyl group having 1 to 20 carbon atoms in which the alkyl group may have a substituent. Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

$R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group.

$R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

X and $X^1$ are, preferably, a hydrogen atom, halogen atom, or alkyl group, and more preferably, hydrogen atom.

L is preferably a group —CHR$^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represents, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represents preferably methyl group. As the primary or secondary alkyl group of 1 to 8 carbon atoms for $R_{13}$, methyl group, ethyl group, propyl group and isopropyl group are more preferred, and methyl group, ethyl group, and propyl group are further preferred.

In a case where each of $R^{11}$, $R^{11'}$ and $R^{12}$ $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above show various different thermo-developing performance depending on the combination of $R^{11}$, $R^{11'}$ and $R^{12}$, $R^{12'}$, as well as $R^{13}$. Since the thermal developing performances can be controlled by using two or more kinds of reducing agents at various mixing ratios, it is preferred to use two or more kinds of reducing agents in combination depending on the purpose.

Specific examples of the compounds represented by general formula (R) according to the invention are shown below but the invention is not restricted to them.

(I-1)

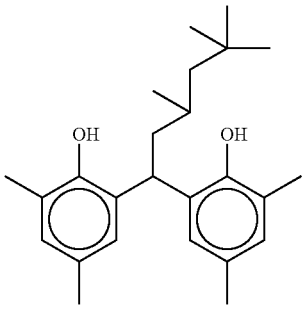

(I-2)

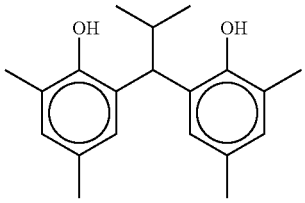

(I-3)

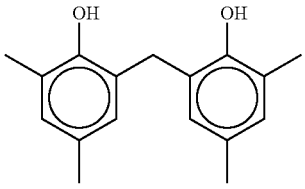

(I-4)

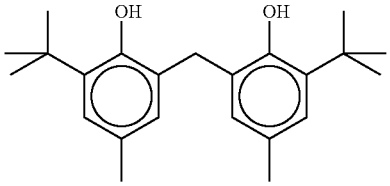

(I-5)

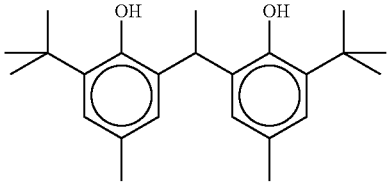

-continued (I-6)

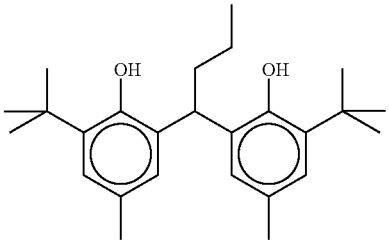

(I-7)

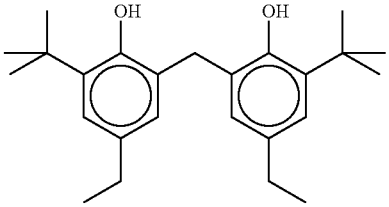

(I-8)

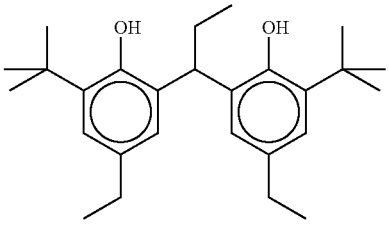

(I-9)

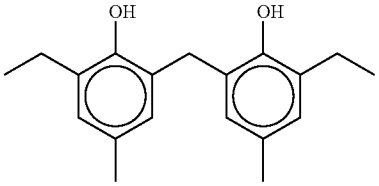

(I-10)

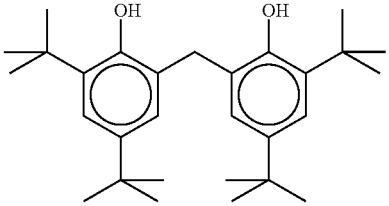

(I-11)

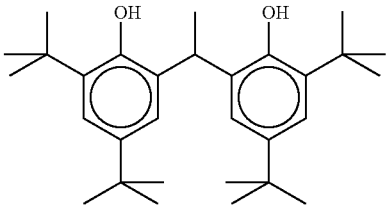

(I-12)

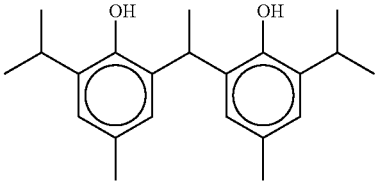

-continued
(I-13)
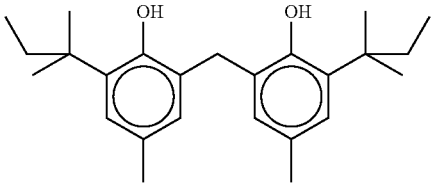
(I-14)
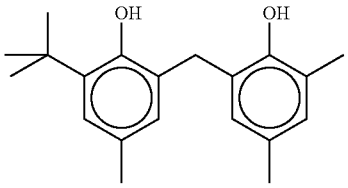
(I-15)
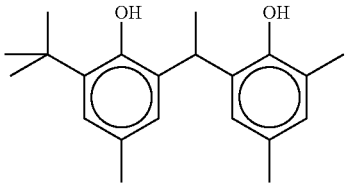
(I-16)
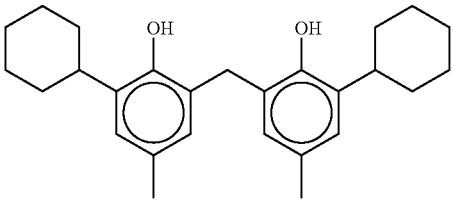
(I-17)
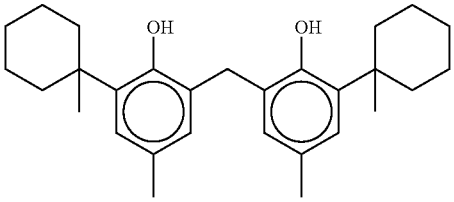
(I-18)
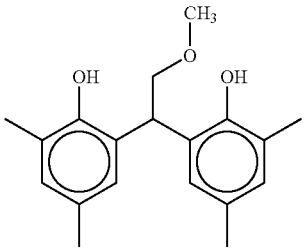
(I-19)
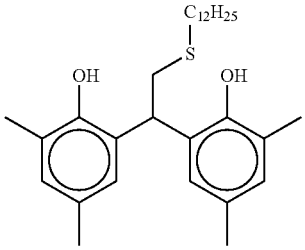
-continued
(I-20)
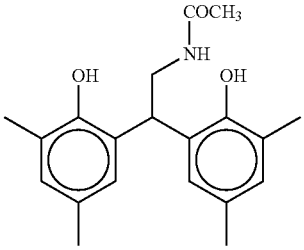
(I-21)
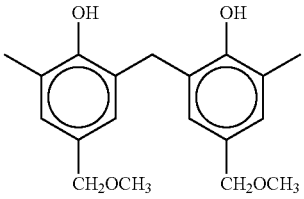
(I-22)
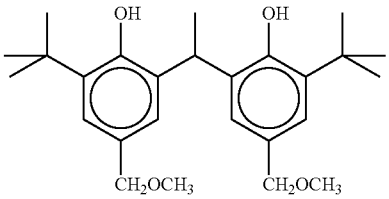
(I-23)
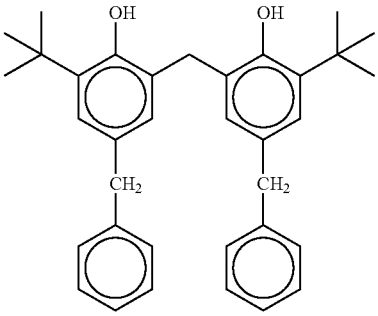
(I-24)
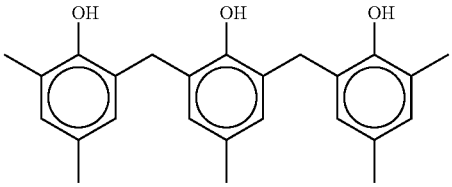
(I-25)
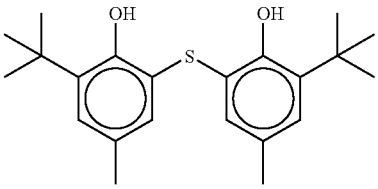
(I-26)
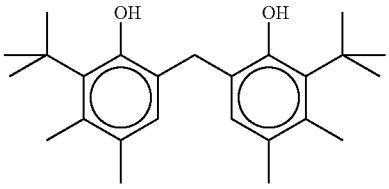

-continued (I-27)

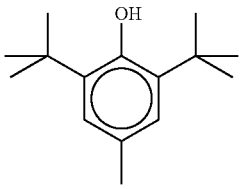

(I-28)

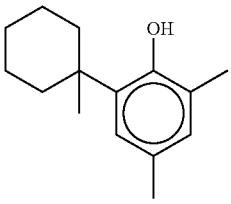

(I-29)

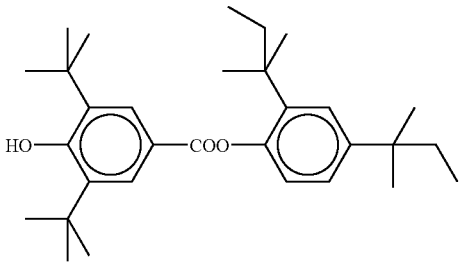

(I-30)

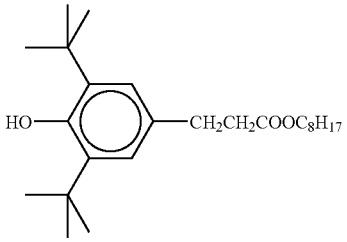

(I-31)

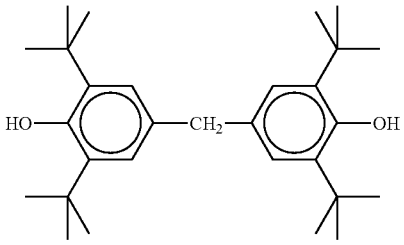

(I-32)

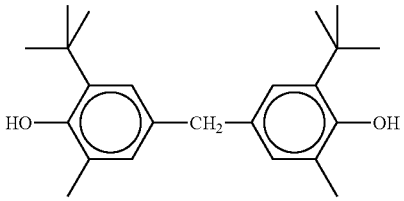

(I-33)

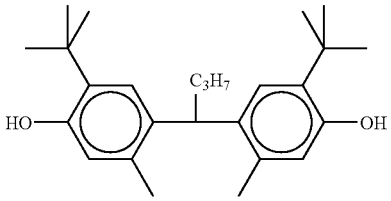

-continued (I-34)

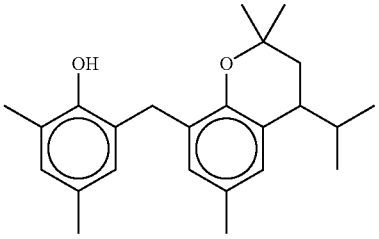

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained by 5 mol % to 50 mol %, more preferably, 8 mol % to 30 mol % and, further preferably, 10 mol % to 20 mol % per one mol of silver in the image forming layer. The reducing agent of the invention it is more preferably contained in the image forming layer.

In the invention, the reducing agent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surface active agent (for instance, an anionic surface active agent such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less with respect to 1 g of silver.

Preferably, a preservative (for instance, sodium benzoisothiazolinone salt) is added in the water dispersion.

In the invention, furthermore, the reducing agent is preferably used as solid dispersion, and is added in the form of fine particles having average particle size from 0.01 μm to 10 μm, and more preferably, from 0.05 μm to 5 μm and, further preferably, from 0.1 μm to 2 μm. In the invention, other solid dispersions are preferably used with this particle size range.

1-4. Development Accelerator

In the photothermographic material of the invention, sulfoneamide phenolic compounds represented by the general formula (A) described in the specification of JP-A No. 2000-267222, and specification of JP-A No. 2000-330234, hindered phenolic compound represented by the general formula (II) described in JP-A No. 2001-92075, hydrazine series compounds represented by general formula (I) described in the specification of JP-A No. 10-62895 and the specification of JP-A No. 11-15116, represented by general formula (D) of JP-A No. 2002-156727 and represented by general formula (1) described in the specification of Japanese Patent Application No. 2001-074278, and phenolic or naphthalic compounds represented by general formula (2) described in the specification of JP-A No. 2001-264929 are used preferably as the development accelerator and they are added preferably.

The development accelerator described above is used within a range from 0.1 mol % to 20 mol %, preferably, within a range from 0.5 mol % to 10 mol % and, more preferably, within a range from 1 mol % to 5 mol % to the reducing agent. The introduction method to the photothermographic material can include, the same method as those for the reducing agent and, it is particularly preferred to add as a solid dispersion or an emulsion dispersion.

In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

1-5. Hydrogen Bonding Compound

In the invention, when the reducing agent in the invention comprises an aromatic hydroxyl group (—OH), particularly when the reducing agent is a bisphenols described above, it is preferred to use in combination, a non-reducing compound having a group capable of reacting with an aromatic hydroxyl group (—OH) of the reducing agent group, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like.

Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferred as the hydrogen-bonding compound is the compound expressed by general formula (D) shown below.

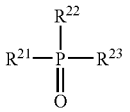

In general formula (D), $R^{21}$ to $R^{23}$ each independently represent an alkyl group, an aryl group, an alkoxy group, an aryloxy group, an amino group, or a heterocyclic group, which may be substituted or not substituted. In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like. As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like. As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As aryloxy groups, there can be mentioned phenoxy group, cresyloxy group, isopropylphenoxy group, 4-t-butylphenoxy group, naphthoxy group, biphenyloxy group, and the like. As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by general formula (D) of the invention and others are shown below, but it should be understood that the invention is not limited thereto.

(II-1)

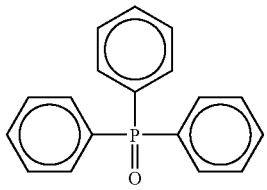

(II-2)

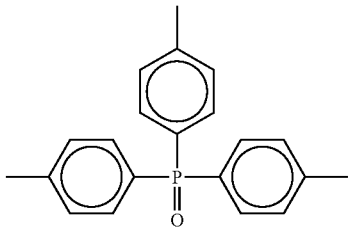

-continued
(II-3)
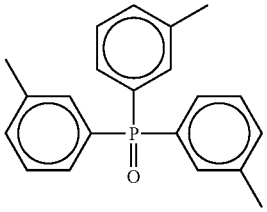
(II-4)
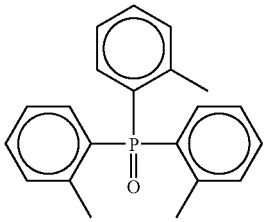
(II-5)
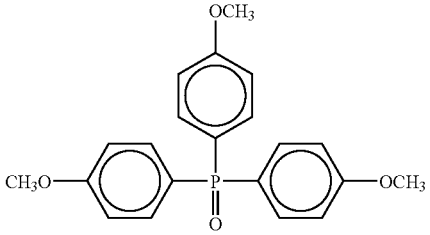
(II-6)
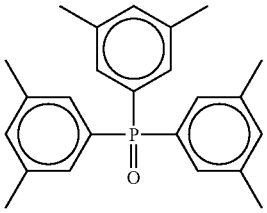
(II-7)
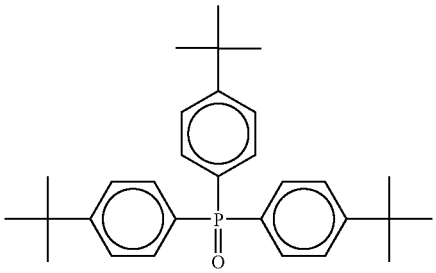
(II-8)
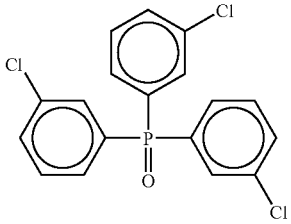
(II-9)
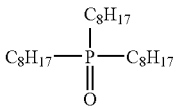
-continued
(II-10)
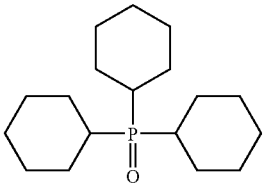
(II-11)
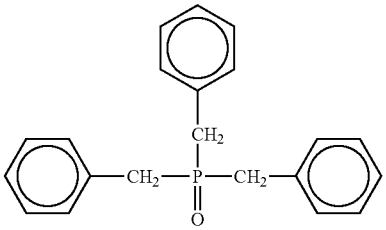
(II-12)
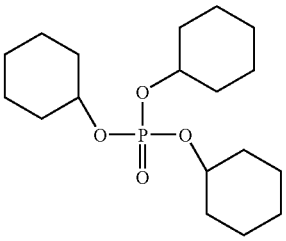
(II-13)
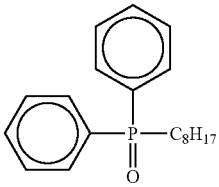
(II-14)
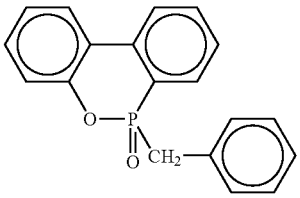
(II-15)
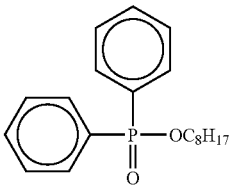
(II-16)
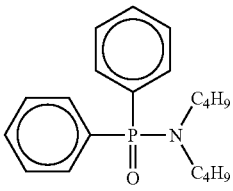

-continued (II-17)

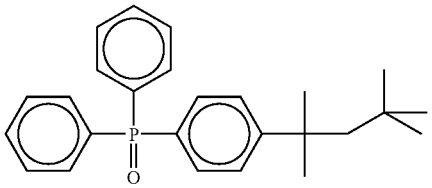

(II-18)

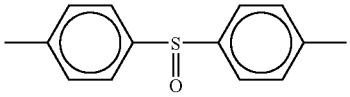

(II-19)

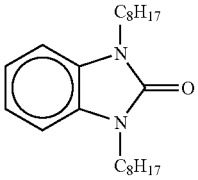

(II-20)

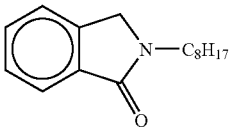

(II-21)

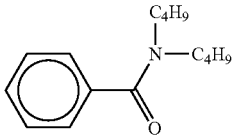

Specific examples of hydrogen bonding compounds other than those enumerated above can be found in those described in EP-A No. 1096310 and in Japanese Patent Application Nos. 2000-270498 and 2001-124796.

The compound expressed by general formula (D) used in the invention can be used in the photosensitive material by being incorporated into the coating solution in the form of solution, emulsion dispersion, or solid-dispersed fine particle dispersion similar to the case of reducing agent. In the solution, the compound expressed by general formula (D) forms a hydrogen-bonded complex with a compound having a phenolic hydroxyl group or an amino group, and can be isolated as a complex in crystalline state depending on the combination of the reducing agent and the compound expressed by general formula (D). It is particularly preferred to use the crystal powder thus isolated in the form of solid-dispersed fine particle dispersion, because it provides stable performance. Further, it is also preferred to use a method of leading to form complex during dispersion by mixing the reducing agent and the compound expressed by general formula (D) in the invention in the form of powders and dispersing them with a proper dispersion solvent using sand grinder mill (SGM) and the like.

The compound general formula (D) is preferably used in a range of from 1 mol % to 200 mol %, more preferably from 10 mol % to 150 mol %, and most preferably, from 20 mol % to 100 mol %, with respect to the reducing agent.

1-6. Binder

Any type of polymer may be used as a binder for the image forming layer in the photosensitive material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal)(e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the Tg of the binder of the layer including organic silver salts is preferably from 10° C. to 80° C., more preferably, from 15° C. to 70° C., further preferably, from 20° C. to 65° C.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition)(Wiley-Interscience, 1989).

The polymer used for the binder may be of one kind or if necessary, two or more kinds of polymers may be used. And the polymer having Tg more than 20° C. and the polymer having Tg less than 20° C. can be used in combination. In a case that two types or more of polymers differing in Tg may be blended for use, it is preferred that the weight-average Tg is in the range mentioned above.

In the invention, it is preferred that the layer containing organic silver salt is formed by first applying a coating solution containing 30% by weight or more of water in the solvent and by then drying.

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent.

As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60%
$RH=[(W1-W0)/W0]\times 100$ (% by weight)

where, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are particularly preferably polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles.

The average particle size of the dispersed particles is in a range of from 1 to 50,000 nm, preferably 5 nm to 1,000 nm, more preferably, 10 nm to 500 nm, and most preferably, 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer.

The molecular weight of these polymers is, in number average molecular weight, in a range of from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

Specific Examples of Polymer Latexes

Specific examples of polymer latexes are given below, but it should be understood that the invention is not limited thereto.

Below are latexes expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg−17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)- (crosslinking)

P-9; Latex of -St(70)-Bu(25)-DVB(2)-AA(3)- (crosslinking)

P-10; Latex of -VC(50)-MMA(20)-EA(20)-AN(5)-AA (5)- (molecular weight 80000)

P-11; Latex of -VDC(85)-MMA(5)-EA(5)-MAA(5)- (molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

Particularly preferred as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably accounts for 60% by weight to 99% by weight with respect to the copolymer. Moreover, the polymer latex of the invention contains acrylic acid or methacrylic acid, preferably, for 1% by weight to 6% by weight, and more preferably, for 2% by weight to 5% by weight, with respect to the total mass of the monomer unit of styrene and that of butadiene. The polymer latex of the invention preferably contains acrylic acid.

As the latex of styrene-butadiene copolymer preferably used in the invention, there can be mentioned P-3 to P-8 and P-15, or commercially available LACSTAR-3307B, 7132C, Nipol Lx416, and the like.

Tg of thus latex of styrene-butadiene copolymer is preferably in the range from 10° C. to 30° C., more preferably 17° C. to 25° C.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

According to the invention, the layer containing organic silver salt (image forming layer) is preferably formed by using polymer latex for the binder. According to the amount of the binder for the layer containing organic silver salt, the weight ratio for total binder to organic silver salt (total binder/organic silver salt) is preferably in a range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide is in a range of from 400/1 to 5/1, more preferably, from 200/1 to 10/1.

In the case water solvent is used for the preparation, the total binder content in the image forming layer is preferably in a range of from 0.2 g/m$^2$ to 30 g/m$^2$, more preferably from 1 g/m$^2$ to 15 g/m$^2$, and further preferably from 2 g/m$^2$ to 10 g/m$^2$. In the image forming layer of the invention, there may be added a crosslinking agent for crosslinking, or a surface active agent and the like to improve coating properties.

1-7. Preferred Solvent for Coating Solution

In the invention, a solvent of an organic silver salt containing layer coating solution (,wherein a solvent and water are collectively as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more.

Examples of a preferable solvent composition is compositions, besides water=100, are compositions in which methyl alcohol is contained in water at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

1-8. Antifoggant

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975.

Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

Organic Polyhalogen Compound

Organic polyhalogen compounds preferably used in the invention are specifically described below.

In the invention, preferred polyhalogen compounds are the compounds expressed by general formula (H) below:

$$Q\text{-}(Y)_N\text{—}C(Z_1)(Z_2)X \qquad \text{General formula (H)}$$

In general formula (H), Q represents an alkyl group, an aryl group, or a heterocyclic group; Y represents a divalent connecting group; N represents 0 or 1; $Z_1$ and $Z_2$ represent a halogen atom; and X represents hydrogen atom or an electron attracting group.

In general formula (H), Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like.

As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp vaule : 0.50) and benzoyl (σp vaule : 0.43)), an alkinyl (e.g., C≡CH (σp vaule : 0.23)), an aliphatic aryl or heterocyclic oxycarbonyl group (e.g., methoxycarbonyl (σp vaule : 0.45) and phenoxycarbonyl (σp vaule : 0.44)), a carbamoyl group (σp vaule : 0.36), sulfamoyl group (σp value: 0.57), sulfoxido group, heterocyclic group, and phosphoryl group. Preferred range of the σp vaule is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. N represents 0 or 1, and preferred is 1.

Specific examples of the compounds expressed by general formula (H) of the invention are shown below.

(III-1)

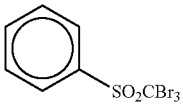

(III-2)

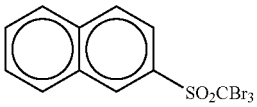

(III-3)

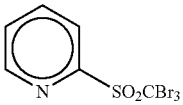

(III-4)

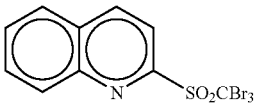

(III-5)

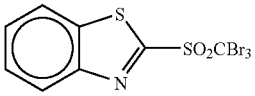

(III-6)

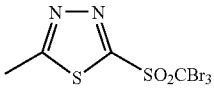

(III-7)

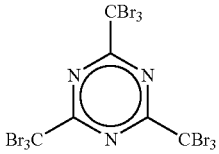

(III-8)

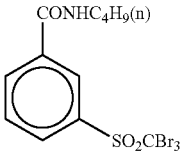

-continued (III-9)

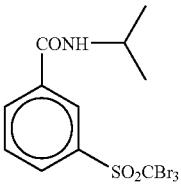

(III-10)

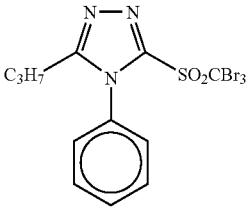

(III-11)

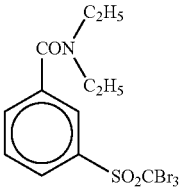

(III-12)

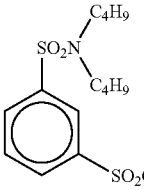

(III-13)

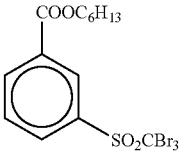

(III-14)

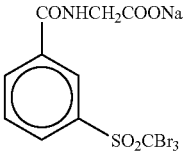

(III-15)

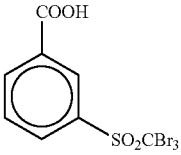

(III-16)

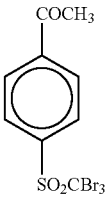

-continued (III-17)

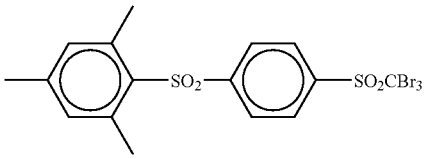

(III-18)

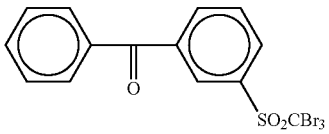

(III-19)

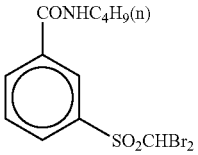

(III-20)

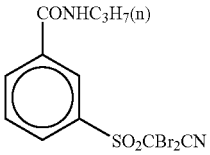

(III-21)

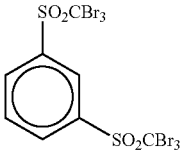

(III-22)

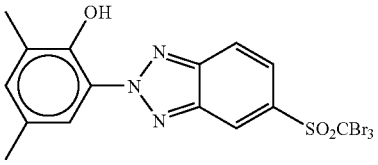

(III-23)

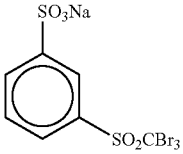

(III-24)

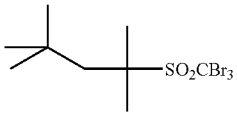

The compounds expressed by general formula (H) of the invention are preferably used in an amount of from $10^{-4}$ mol to 0.5 mol, more preferably, $10^{-3}$ mol to 0.1 mol, and most preferably, $5\times10^{-3}$ mol to 0.05 mol, per one mol of non-photosensitive silver salt incorporated in the image forming layer.

The compound represented by general formula (H) can be added to any layer as long as located on the side of the image forming layer toward the support, preferably to the image forming layer or the layer adjacent to the image forming layer, more preferably to the image forming layer.

In the invention, usable methods for incorporating the antifoggant into the photosensitive material are those described above in the method for incorporating the reducing agent; similarly, for the organic polyhalogen compound, it is preferably added in the form of a solid particle dispersion.

Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by general formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by general formula (XI) as described in JP-A No. 59-193447, a compound described in JP-B No. 55-12581, and a compound expressed by general formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt.

The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like.

In the invention, the azolium salt may be added at any amount, but preferably, it is added in a range of from $1\times10^{-6}$ mol to 2 mol, and more preferably, from $1\times10^{-3}$ mol to 0.5 mol per one mol of silver.

1-9. Other Additives

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by general formula (I) of JP-A No. 10-186572 and specific examples thereof shown in paragraph Nos. 0033 to 0052, and in lines 36 to 56 in page 20 of EP No. 0803764A1. Among them, mercapto-substituted heterocyclic aromatic compound described in JP-A Nos. 9-297367, 9-304875, and 2001-100358, and the like, are particularly preferred.

2) Toner

In the photothermographic material of the present invention, the addition of a toner is preferred. The description of the toner can be found in JP-A No.10-62899 (paragraph Nos. 0054 to 0055), EP-A No.0803764A1 (page21, lines 23 to 48), JP-A Nos.2000-356317 and 2000-187298. Preferred are phthalazinones (phthalazinone, phthalazinone derivatives and metal salts thereof, e.g.,4-(1-naphthyl)phthalazinone,6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine,6-isopropylphthalazine, 6-terbutylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids.

Preferred addition amount of the toner in the invention is in the range from 2 mol to 20 mol, more preferably 3 mol to 15 mol, further preferably 4 mol to 10 mol per one mol of photosensitive silver halide.

It is preferred to use a toner in the combination with phthalic acids. Particularly preferred are the combination of 6-isopropylphthalazine and phthalic acid, and the combination of 6-isopropylphthalazine and 4-methlyphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573 and in paragraph Nos. 0049 to 0062 of Japanese Patent Application No. 11-106881.

4) Dyes and Pigments

From the viewpoint of improving image tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

5) Ultra-high Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in Japanese Patent Application No. 11-87297, as compounds expressed by formulae (III) to (V) (specific compound: chemical No.21 to chemical No.24) in Japanese Patent Application No. 11-91652; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like.

Particularly preferred acids obtainable by the hydration of diphosphorus pentaoxide or salts thereof include orthophosphoric acid (salt) and hexametaphosphoric acid (salt) Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 $mg/m^2$ to 500 $mg/m^2$, and more preferably, of 0.5 $mg/m^2$ to 100 $mg/m^2$.

1-10. Layer Constitution

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two layers or more, the first image forming layer (in general, a layer placed adjacent to the support) contains an organic silver salt and a photosensitive silver halide, and some of the other components must be incorporated in the second image forming layer or in both of the layers.

The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or nonfunctional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (1) a surface protective layer provided on the image forming layer (on the side farther from the support), (2) an intermediate layer provided among plural image forming layers or between the image forming layer and the protective layer, (3) an undercoat layer provided between the image forming layer and the support, and (4) a back layer provided to the side opposite to the image forming layer.

Furthermore, a layer that functions as an optical filter may be provided as (1) or (2) above. An antihalation layer may be provided as (3) or (4) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.).

The coverage of polyvinyl alcohol (per 1 $m^2$ of support) in the protective layer (per one layer) is preferably in a range of from 0.3 $g/m^2$ to 4.0 $g/m^2$, and more preferably, from 0.3 $g/m^2$ to 2.0 $g/m^2$.

2) Antihalation Layer

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the present case the exposure wavelength has the peak wavelength in the range from 350 nm to 440 nm, a dye absorbing those region in wavelength may be used.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably, from 0.2 to 1. The usage of dyes to obtain optical density in the above range is generally from about 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In thermal bleaching process using such a thermal bleaching dye and a base precursor, preferred is to use a substance (for instance, diphenylsulfone, 4-chlorophenyl(phenyl)sulfone, and the like) as disclosed in JP-A No. 11-352626, as well as 2-naphthyl benzoate and the like, which is capable of lowering the melting point of a base precursor by 3° C. when mixed with a basic precursor from the viewpoint of thermal bleaching property or the like.

3) Back Layer

According to the invention, it is preferred that the photothermographic material is a one-side photographic material, that is, the photothermographic material has, on one side of the support, at least one image forming layer comprising silver halide emulsion and on the other side of the support a back layer.

Back layers usable in the invention are described in paragraph Nos. 0128 to 0130 of JP-A No. 11-65021.

In the invention, coloring matters having maximum absorption in the wavelength range of from 300 nm to 450 nm may be added in order to improve a color tone of developed images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range of from 0.1 $mg/m^2$ to 1 $g/m^2$, preferably to the back layer provided to the side opposite to the photosensitive layer.

4) Matting Agent

A matting agent may be preferably added to the photothermographic material of the invention in order to improve transportability. Description on the matting agent can be found in paragraphs Nos. 0126 to 0127 of JP-A No.11-65021. The amount of adding the matting agents is preferably in the range from 1 $mg/m^2$ to 400 $mg/m^2$, more preferably, from 5 $mg/m^2$ to 300 $mg/m^2$, with respect to the coating amount per one $m^2$ of the photosensitive material.

There is no particular restriction on the shape of the matting agent usable in the invention and it may fixed form or non-fixed form. Preferred is to use those having fixed form and globular shape. Average particle size is preferably in the range of from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more; most preferably, 500 seconds or less and 40 seconds or more when expressed by Beck smoothness.

5) Polymer Latex

In the case of the photothermographic material of the invention for graphic arts in which changing of dimension is critical, it is preferred to incorporate polymer latex in the surface protective layer and the back layer. As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate(5.0% by weight)/acrylic acid copolymer, and the like.

The polymer latex in the surface protective layer preferably is contained in an amount of 10% by weight to 90% by weight, particularly preferably, of 20% by weight to 80% by weight of the total weight of binder.

The coating amount of the total binder (including water-soluble polymer and latex polymer) in the surface protective layer (per one layer) is preferably 0.3 g/m$^2$ to 5.0 g/m$^2$, more preferably, 0.3 g/m$^2$ to 2.0 g/m$^2$ per one m$^2$ of a support.

6) Surface pH

The surface pH of the photothermographic material according to the invention preferably yields a pH of 7.0 or lower, more preferably, 6.6 or lower, before thermal development treatment. Although there is no particular restriction concerning the lower limit, the lower limit of pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

8) Surface Active Agent

Concerning about the surface active agent which can be used in the invention is described in paragraph No. 0132 of JP-A No.11-65021.

In the invention, preferably used are fluorocarbon surface active agent. Specific examples of fluorocarbon surface active agents can be found in those described in JP-A Nos. 10-197985, 2000-19680, and 2000-214554. Polymer fluorocarbon surface active agents described in JP-A 9-281636 can be also used preferably. For the photothermographic material in the invention, the fluorocarbon surface active agents described in JP-A Nos. 2002-82411, 2001-242357, and 2001-264110 are preferably used. Especially, the usage of the fluorocarbon surface active agents described in JP-A Nos. 2001-242357 and 2001-264110 in an aqueous coating solution is preferred viewed from the standpoint of capacity in static control, stability of the coating side state and sliding facility. The fluorocarbon surface active agent described in JP-A No. 2001-264110 is mostly preferred because of high capacity in static control and that it needs small amount to use.

According to the invention, the fluorocarbon surface active agent can be used on either side of image forming layer side or back layer side, but is preferred to use on the both sides. Further, it is particularly preferred to use in combination with electrically conductive layer including aforementioned metal oxides. In this case the amount of the fluorocarbon surface active agent on the side of the electrically conductive layer can be reduced or removed.

The amount of the fluorocarbon surface active agent used is preferably in the range of 0.1 mg/m$^2$ to 100 mg/m$^2$ on each side of image forming layer and back layer, more preferably 0.3 mg/m$^2$ to 30 mg/m$^2$, further preferably 1 mg/m$^2$ to 10 mg/m$^2$. Especially, the fluorocarbon surface active agent described in Japanese Patent Application No. 2001-264110 is effective, and used preferably in the range of 0.01 mg/m$^2$ to 10 mg/m$^2$, more preferably 0.1 mg/m$^2$ to 5 mg/m$^2$.

9) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use.

Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb.

The amount of adding different types of atoms is preferably in a range of from 0.01 mol % to 30 mol %, and particularly preferably, in a range of from 0.1 mol % to 10 mol %. The shape of the metal oxides can include, for example, spherical, needle-like, or plate-like shape. The needle-like particles, with the rate of (the major axis)/(the minor axis) is more than 2.0, or more preferably, 3.0 to 50, is preferred viewed from the standpoint of the electric conductivity effect.

The metal oxides is used preferably in the range from 1 mg/m$^2$ to 1000 mg/m$^2$, more preferably from 10 mg/m$^2$ to 500 mg/m$^2$, and further preferably from 20 mg/m$^2$ to 200 mg/m$^2$.

The antistatic layer can be laid on either side of the image forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, US-P No. 5575957, and in paragraph Nos. 0078 to 0084 of JP-A No. 11-223898.

10) Support

As the transparent support, favorably used is polyester, particularly, polyethylene terephthalate, which is subjected to heat treatment in the temperature range of from 130° C.

to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-I described in the example of JP-A No. 8-240877), or may be uncolored. Example of the support is described in paragraph No. 0134 of JP-A No.11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like.

The photothermographic material of the invention is preferably a so-called one-side photosensitive material, which comprises at least one layer of a photosensitive layer containing silver halide emulsion on one side of the support, and a back layer on the other side.

11) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like. Besides, concerning about a method to obtain a colored image is described in paragraph No. 0136 of JP-A No. 11-65021.

12) Preparation of Coating Solution and Viscosity Characteristic

A preparation temperature of an image forming layer coating solution of the invention is preferably 30° C. or higher and 65° C. or lower, more preferably 35° C. or higher and lower than 60° C., and still more preferably 35° C. or higher and 55° C. or lower. It is preferable to keep a temperature of the image forming layer coating solution immediately after addition of a polymer latex at 30° C. or higher and 65° C. or lower.

An organic silver salt containing layer coating solution in the invention is preferably a thixotropic fluid. This technique can be found as a reference in JP-A No. 11-52509.

A viscosity less at a shear rate of 0.1 $S^{-1}$ of an organic silver salt containing layer coating solution in the invention is preferably 400 mpa·s or more and 100,000 mPa·s or less and more preferably 500 mPa·s or more and 20,000 mpa·s or less. The viscosity at a shear rate of 1000 $s^{-1}$ is preferably 1 mPa·s or more and 200 mPa·s or less and more preferably 5 mPa·s or more and 80 mPa·s or less.

13) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099 and 11-343420.

In instances of multi-color photothermographic materials, each photosensitive layer is in general, held distinctively each other by using a functional or nonfunctional barrier layer between each photosensitive layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

2. Image Forming Method 2-1. Exposure

An image forming method applied to a photothermographic material of the invention is preferably to expose the above photothermographic material with a layer diode having a light emission peak in the range of from 350 nm to 450 nm as a light source.

A photothermographic material of the invention exerts its characteristic in a short time exposure to light at a high intensity of 1 $mW/mm^2$ or higher. With an exposure at such a high intensity applied, a sufficient sensitivity can be obtained even in a photothermographic material containing a silver halide emulsion with a high silver iodide content and a non-photosensitive organic silver salt. That is, high intensity exposure of the application can ensure a high sensitivity as compared with the case of low intensity exposure.

While an illumination intensity in the invention is 1 $mW/mm^2$ or higher, the intensity is more preferably 2 $mW/mm^2$ to 50 $W/mm^2$, and further more preferably 10 $mW/mm^2$ to 50 $W/mm^2$.

While a photothermographic material of the invention may be exposed by any method, an exposure source is preferably a laser beam.

Laser light preferably used in the invention is a gas laser ($AR^+$, KR), a YAG laser, a dye laser, a laser diode and the like. In some case, a laser and a second harmonic generating element or the like can also be used. A laser diode with blue to ultraviolet emission is more preferably used, a laser diode with an emission-peak intensity in the range of from 350 nm to 450 nm in wavelength is still more preferably used and a laser diode with an emission-peak intensity in the range of from 390 nm to 430 nm in wavelength is yet more preferably used.

A NLHV 3000E laser diode fabricated by Nichia Corporation can be exemplified as a high output laser diode with blue to ultraviolet emission. A laser with an output of 35 mW at a wavelength of 405 nm has been laid open in public, and with such a laser beam employed, it is possible to obtain a high intensity in the range of from 390 nm to 430 nm in wavelength which is particularly preferable in the invention.

2-2. Thermal Development

Although the development of the photothermographic material of the invention is usually performed by elevating the temperature of the photothermographic material exposed imagewise, any method may be used for this thermal development process. The temperature for the development is preferably 80° C. to 250° C., preferably 100° C. to 140° C., and more preferably 110° C. to 130° C. Time period for the development is preferably 1 second to 60 seconds, more preferably 3 seconds to 30 seconds, particularly preferably 5 seconds to 25 seconds, and most preferably 7 seconds to 15 seconds.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

Time from Exposure Until Thermal Development

A photothermographic material of the invention is desirably thermal developed within 60 sec after exposure. The photothermographic material is thermal developed more preferably within 30 sec after the exposure and still more preferably within 15 sec after the exposure. In order to obtain a high sensitivity, it is desirable to start thermal development within the shortest possible time after exposure.

The term "a time from exposure until the start of thermal development" means an average of times from exposure of individual portions in one sheet of a photothermographic material until thermal development is started on the same individual portions.

In order to reduce a time from exposure until thermal development as described above, it is possible to decrease a distance between an exposing portion and a developing portion. The term "an exposing portion" here means a position at which a photothermographic material is illuminated with light from an exposure light source and the term "a developing portion" means a position at which the photothermographic material is heated for the first time for effecting thermal development.

Figure 2:
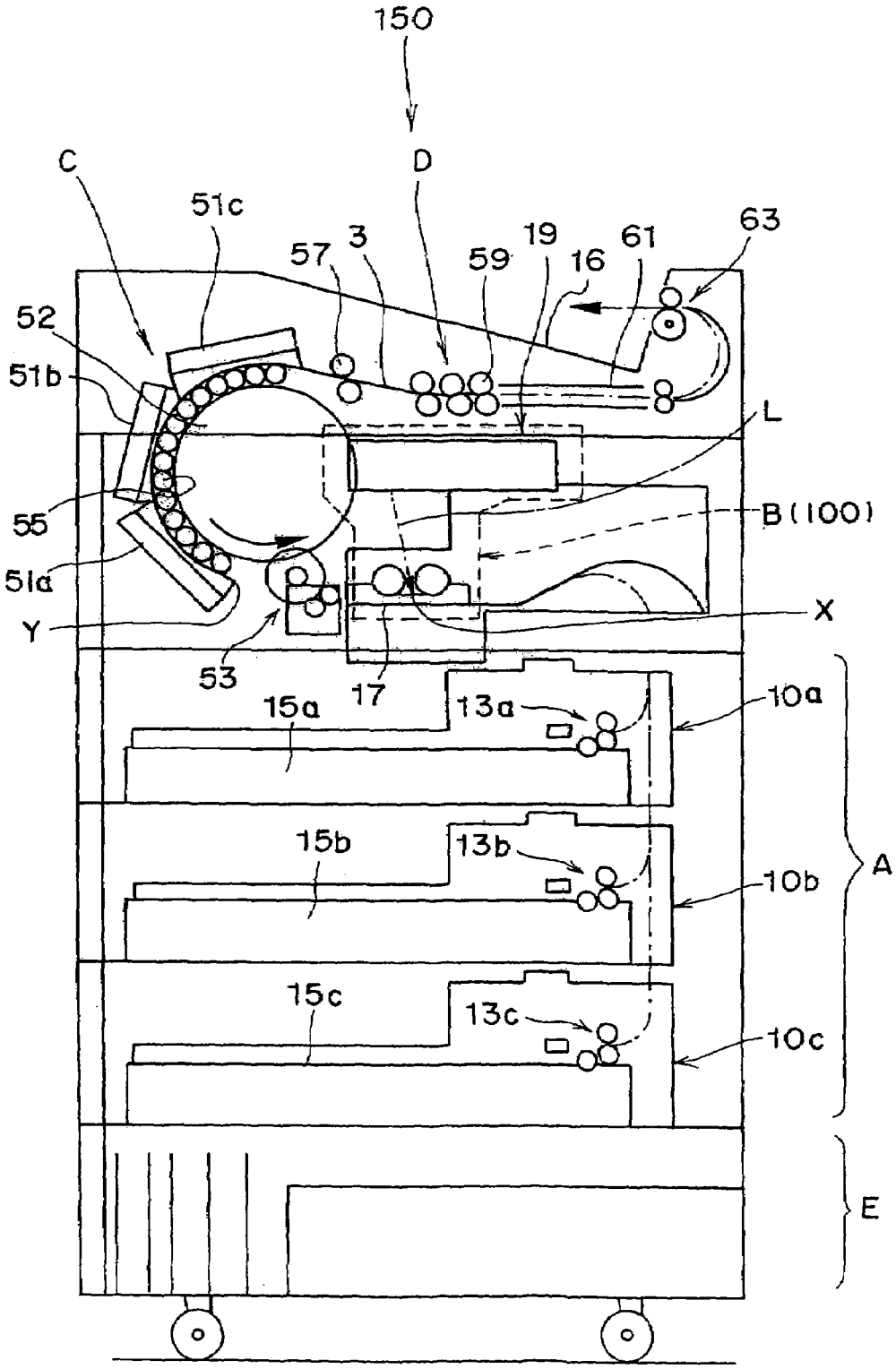
FIG. 2 is a schematic view of an image recording device comprising a laser recording portion according to the present invention.
Figure 3:
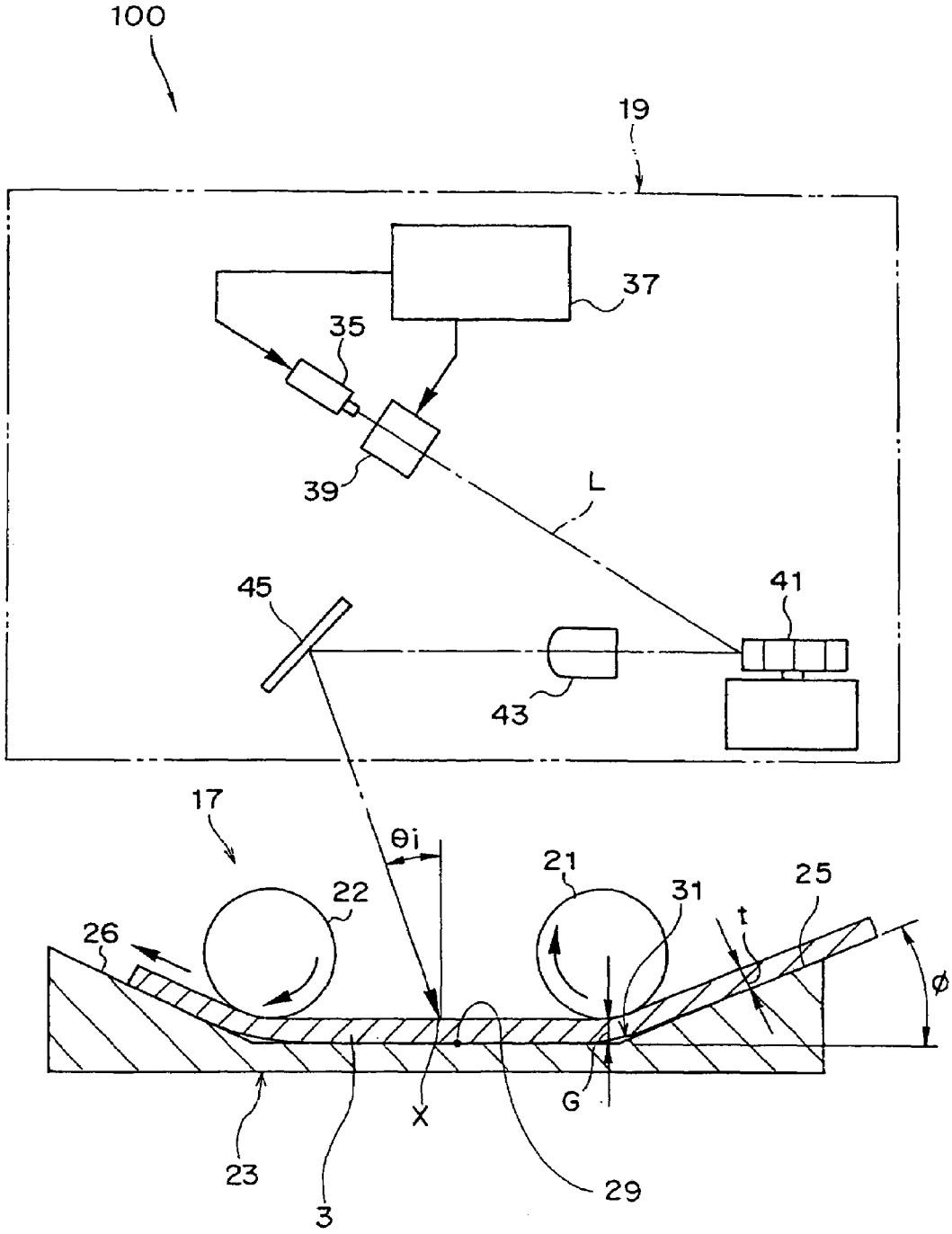
FIG. 3 is a schematic view of a transport portion for transporting a photothermographic material in a sheet-like shape and scanning exposure portion.

More definite description will be given of an image forming method of the invention showing a concrete image recording apparatus. In FIG. 2 and FIG. 3, there is shown one example of an image recording apparatus of the invention.

First of all, description will be given of symbols used in FIGS. 2 and 3 below.

3. Photothermographic Material

10*a*, 10*b*, 10*c* photothermographic material tray
13*a*, 13*b*, 13*c* single-sheet transport roller
15*a*, 15*b*, 15*c* photothermographic material
16 top light shielding cover
17 auxiliary transport portion (sub-scanning means)
19 scanning exposure portion (laser irradiating means)
21, 22 driving roller
23 guide plate
25, 26 slope portion
29 presser portion
30 exposure guide slit
31 guide plate
35 laser diode
37 driving circuit
39 intensity modulator
41 polygon mirror
43 collective lens
45 mirror
51*a*, 51*b*, 51*c* thermal development plate
52 driving roller
53 reduction gear
55 transport opposite roller
57 cooling rotor
59 cooling rotor
61 cooling plate
63 discharging roller
100 laser recording apparatus
150 thermal development recording apparatus An exposing portion is X in FIG. 3 and a developing portion is Y at which a photothermographic material, transported from 53 of FIG. 2, is brought into a contact with a plate 51*a* for the first time.

By reducing a distance between the exposing portion and the developing portion, a state is achieved where a part of a sheet-like photothermographic material is exposed and in parallel with the exposure, development is started on a part of the sheet having been already exposed. By using an image forming method in which a part of the photothermographic material is exposed and in parallel with the exposure, a part thereof is developed, a time from exposure until development is reduced and with even a photothermographic material using a silver halide with a high silver iodide content, to be of a low sensitivity can be suppressed.

3. Wrapping Material

In order to suppress fluctuation from occurring on the photographic performance during a preservation of the photosensitive material of the invention before thermal development, or in order to improve curling or winding tendencies, it is preferred that a wrapping material having low oxygen transmittance and/or vapor transmittance is used.

Preferably, oxygen transmittance is 50 ml/atm·$m^2$·day or lower at 25° C., more preferably, 10 ml/atm·$m^2$·day or lower, and most preferably, 1.0 ml/atm·$m^2$·day or lower. Preferably, vapor transmittance is 10 g/atm·$m^2$·day or lower, more preferably, 5 g/atm·$m^2$·day or lower, and most preferably, 1 g/atm·$m^2$·day or lower.

As specific examples of a wrapping material having low oxygen transmittance and/or vapor transmittance, reference can be made to, for instance, the wrapping material described in JP-A Nos.8-254793 and 2000-206653.

4. System

Examples of a medical laser imager equipped with a light exposing part and a thermal developing part include Fuji Medical Dry Laser Imager FM-DP L.

In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

5. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1-1. Preparation of PET Support (Film Manufacturing)

PET having IV (intrinsic viscosity) of 0.66 (measured in phenol/tetrachloroethan=6/4 (weight ratio) at 25° C.) was obtained according to a conventional manner using terephthalic acid and ethylene glycol. The product was pelletized, dried at 130° C. for 4 hours, melted at 300° C., and the dye BB having the following structure was included at 0.04% by weight. Thereafter, the mixture was extruded from a T-die and rapidly cooled to form a non-tentered film having such a thickness that the thickness should become 175 μm after tentered and thermal fixation.

dye BB

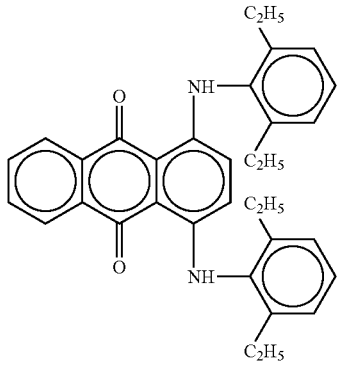

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking parts were slit off, and both edges of the film were knurled. Then the film was rolled up at the tension of 4 kg/cm$^2$ to obtain a roll having the thickness of 175 μm.

(Surface Corona Discharge Treatment)

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

(Undercoating)

Preparation of Coating Solution for Undercoat Layer

Formula (1) (for undercoat layer on the image forming layer side)

| | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 mL |

Formula (2) (for First Layer on the Back Surface)

| | |
|---|---|
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |

Formula (3) (for Second Layer on the Back Surface)

| | |
|---|---|
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| distilled water | 805 mL |

1-2. Preparation of Undercoated Support

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

(Preparation of Coating Solution for Back Layer)

1) Preparation of Coating Solution for Antihalation Layer 32.7 g of lime processed gelatin, 0.77 g of monodispersed polymethyl methacrylate fine particles (mean particle size of 8 μm, standard deviation of particle diameter of 0.4), 0.08 g of benzoisothiazolinone, 0.3 g of sodium polystyrenesulfonate, 0.06 g of blue dye-1, 1.5 g of ultraviolet absorber-1, 5.0 g of acrylic acid/ethyl acrylate copolymer latex (copolymerization rate 5/95) and 1.7 g of N,N'-ethylene-bis (vinylsufoneacetamide) were added to the water kept at 40° C. and mixed. pH was ajusted to 6.0 with a 1 mol/L aqueous sodium hydroxide solution. Then, water was added to give the total volume of 818 mL to prepare a coating solution for the antihalation layer.

2) Preparation of Coating Solution for Back Surface Protective Layer

A vessel containing water was kept at 40° C., and thereto were added 66.5 g of lime processed gelatin, liquid paraffin emulsion at 5.4 g equivalent to liquid paraffin, 0.10 g of benzoisothiazolinone, 0.5 g of di(2-ethylhexyl) sodium sulfosuccinate, 0.27 g of sodium polystyrenesulfonate, 13.6 mL of a 2% by weight aqueous solution of a fluorocarbon surface active agent (F-1) and 10.0 g acrylic acid/ethyl acrylate copolymer latex (copolymer weight ratio of 5/95) were admixed. pH was adjusted to 6.0 with a 1 mol/L aqueous sodium hydroxide solution. Then water was added to give the total volume of 1000 mL to prepare a coating solution for the back surface protective layer.

1-3. Image Forming Layer, Intermediate Layer and Surface Protecting Layer

1-3-1. Preparation of Coating Materials

1) Preparation of Silver Halide Emulsion

<<Preparation of Silver Halide Emulsion-1>> ($AgBR_{96.5}I_{3.5}$)

To 1420 mL of distilled water was added 3.1 mL of a 1% by weight potassium bromide solution. Further, a liquid added with 3.5 mL of 0.5 mol/L sulfuric acid and 36.5 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with 0.5 mol/L sulfuric acid. After stopping stirring, the mixture was subjected to precipitation/desalting/water washing steps.

The mixture was adjusted to the pH of 5.9 with 1 mol/L sodium hydroxide to produce a silver halide dispersion having the pAg of 8.0.

The above-mentioned silver halide dispersion was kept at 38° C. with stirring, and thereto was added 5 mL of a 0.34% by weight methanol solution of 1,2-benzoisothiazoline-3-one, followed by elevating the temperature to 47° C. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes.

Thereto was added 1.3 mL of a 0.8% by weight N,N'dihydroxy-N",N"-diethylmelamine in methanol, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver were added to produce a silver halide emulsion-1.

Grains in thus prepared silver halide emulsion were silver iodobromide grains containing 3.5 mol % of silver iodide. The grains had a mean sphere equivalent diameter of 0.040 μm, a variation coefficient of 18%. Grain size and the like were determined from the average of 1000 grains using an electron microscope.

<<Preparation of Silver Halide Emulsion-2>> ($AgI_{100}$)

To 1420 mL of distilled water was added 4.3 mL of a 1% by weight potassium iodide solution. Further, a liquid added with 3.5 mL of 0.5 mol/L sulfuric acid and 36.5 g of phthalated gelatin was kept at 30° C. while stirring in a stainless steel reaction pot, and thereto were added total amount of: solution A prepared through diluting 22.22 g of silver nitrate by adding distilled water to give the volume of 217.8 mL; and solution B prepared through diluting 21.8 g of potassium iodide with distilled water to give the volume of 217.8 mL, over 9 minutes at a constant flow rate. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 508.2 mL and a solution D prepared through diluting 63.9 g of potassium iodide with distilled water to give the volume of 638.6 mL were added. A controlled double jet method was executed through adding total amount of the solution C at a constant flow rate over 120 minutes, accompanied by adding the solution D while maintaining the pAg at 10.0. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with 0.5 mol/L sulfuric acid. After stopping stirring, the mixture was subjected to precipitation/desalting/water washing steps.

The mixture was adjusted to the pH of 5.9 with 1 mol/L sodium hydroxide to produce a silver halide dispersion having the pAg of 8.0. Other conditions were established similar to the preparation of silver halide emulsion-1 to produce a silver halide emulsion-2.

Grains in thus prepared silver halide emulsion were tetradecahedron shaped pure silver iodide grains having a mean sphere equivalent diameter of 0.038 μm, a variation coefficient of 20%.

<<Preparations of Silver Halide Emulsion-3 and -4>>

($AgI_{90}BR_{10}$, $AgI_{90}Cl_{10}$)

Preparation of silver halide emulsion-3 was conducted in the similar manner to the preparation of silver halide emulsion-2 except that; using a solution obtained by diluting 19.6 g of potassium iodide and 1.6 g of potassium bromide with distilled water to give the volume of 217.8 mL instead of using solution B; and using a solution obtained by diluting 57.5 g of potassium iodide and 4.6 g of potassium bromide with distilled water to give the volume of 638.6 mL instead of using solution D.

Grains in thus prepared silver halide emulsion were tetradecahedron shaped, silver iodobromide grains containing 90 mol % of silver iodide. The grains had a mean sphere equivalent diameter of 0.041 μm, a variation coefficient of 19%.

Further, preparation of silver halide emulsion-4 was conducted in the similar manner to the preparation of silver halide emulsion-2 except that; using a solution obtained by diluting 19.6 g of potassium iodide and 0.76 g of sodium chloride with distilled water to give the volume of 217.8 mL instead of using solution B; and using a solution obtained by diluting 57.5 g of potassium iodide and 2.2 g of sodium chloride with distilled water to give the volume of 638.6 mL instead of using solution D.

Grains in thus prepared silver halide emulsion were tetradecahedron shaped, silver iodochloride grains containing 90 mol % of silver iodide. The grains had a mean sphere equivalent diameter of 0.042 μm, a variation coefficient of 21%.

<<Preparation of Mixed Emulsion-1 to -4 for Coating Solution>>

Either of the silver halide emulsion-1 to -4 was dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution.

2) Preparation of Dispersion of Silver Salt of Fatty Acid 87.6 kg of behenic acid (Henkel Co., trade name: Edenor C22-85R), 423 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of a sodium behenate was thereafter started, and during 14 minutes and 15 seconds following the completion of adding the aqueous silver nitrate solution, the added material was restricted to the solution of a sodium behenate alone. The temperature inside of the reaction vessel was then set to be 30° C., and the temperature outside was controlled so that the liquid temperature could be kept constant.

In addition, the temperature of a pipeline for the addition system of the solution of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate was added and the position at which the aqueous silver nitrate solution was added were arranged symmetrically with a shaft for stirring located at a center. Moreover, both of the positions were adjusted to avoid contact with the reaction liquid.

After completing the addition of the solution of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

3) Preparation of Reducing Agent Dispersion

<<Preparation of Reducing Agent-1 Dispersion>>

To 10 kg of a reducing agent-1 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. Accordingly, a reducing agent-1 dispersion was obtained.

Particles of the reducing agent included in the resulting reducing agent-1 dispersion had a median diameter of 0.40 μm, and a maximum particle diameter of 1.5 μm or less. The resultant reducing agent-1 dispersion was subjected to filtration with a polypropylene filter having a pore size of 3.0 μm to remove foreign substances such as dust, and stored.

4) Preparation of Hydrogen Bonding Compound Dispersion

<<Preparation of Hydrogen Bonding Compound-1 Dispersion>>

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the hydrogen bonding compound to be 25% by weight. Accordingly, a hydrogen bonding compound-1 dispersion was obtained.

Particles of the hydrogen bonding compound included in the resulting hydrogen bonding compound-1 dispersion had a median diameter of 0.35 μm, and a maximum particle diameter of 1.5 μm or less. The resultant hydrogen bonding compound-1 dispersion was subjected to filtration with a polypropylene filter having a pore size of 3.0 μm to remove foreign substances such as dust, and stored.

5) Preparations of Development Accelerator Dispersion and Color-Adjusting-Agent Dispersion <<Preparation of Development Accelerator-1 Dispersion>>

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minuets. Thereafter, 0.2 g of a benzoisothiazolinone sodium salt and water were added thereto, thereby adjusting the concentration of the development accelerating agent to be 20% by weight. Accordingly, a development accelerator-1 dispersion was obtained.

Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<<Preparations of Development Accelerator-2 Dispersion, Development Accelerator-3 Dispersion and Color-Adjusting-Agent-1 Dispersion>>

Also concerning solid dispersions of a development accelerator-2, a development accelerator-3 and a color-tone-adjusting agent-1, dispersion was executed in a similar manner to the development accelerator-1, and thus dispersions of 20% by weight were obtained.

6) Preparations of Polyhalogen Compound Dispersion

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-1 dispersion was obtained.

Particles of the organic polyhalogen compound included in the resulting polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion.

Particles of the organic polyhalogen compound included in the resulting polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Phthalazine Compound Solution (Preparation of Phthalazine Compound-1 Solution)

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound-1 to prepare a 5% by weight phthalazine compound-1 solution.

8) Preparations of Mercapto Compound Solution

<<Preparation of an Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

9) Preparation of Pigment Dispersion

<<Preparation of Pigment-1 Dispersion>>

C.I. Pigment Blue 60 in an amount of 64 g and 6.4 g of DEMOL N manufactured by Kao Corporation were added to 250 g water and thoroughly mixed to give slurry. Zirconia beads having the mean particle diameter of 0.5 mm were provided in an amount of 800 g, and charged in a vessel with the slurry. Dispersion was performed with a dispersing machine (¼G sand grinder mill: manufactured by IMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

10) Preparation of SBR Latex Solution

<<Preparation of SBR Latex Solution>>

SBR latex was prepared as described below.

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO.,LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereinto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion: $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

1-3-2. Preparations of Coating Solutions

1) Preparation of Coating Solution for Image Forming Layer-1 to -4

To the dispersion of the silver salt of fatty acid obtained as described above in an amount of 1000 g and 276 mL of water were serially added 173 g of the phthalazine compound-1 solution, 1082 g of the SBR latex (Tg: 17° C.) solution, 155 g of the reducing agent-1 dispersion, 55 g of the hydrogen bonding compound-1 dispersion, 1 g of the development accelerator-1 dispersion, 2 g of the development accelerator-2 dispersion, 3 g of the development accelerator-3 dispersion, 2 g of the color-tone-adjusting agent-1 dispersion, 9 mL of the mercapto compound-1 aqueous solution and 27 mL of the mercapto compound-2 aqueous solution. The coating solution for the image forming layer prepared by adding either of the silver halide mixed emulsion-1 to -4 in an amount of 117 g thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 25° C. when it was measured using RFS fluid spectrometer manufactured by Rheometrix Far-East Co. Ltd. was 530,144,96,51 and 28 [mPa·s], respectively, at the shearing rate of 0.1, 1, 10, 100, 1000 [1/second].

The amount of zirconium in the coating solution was 0.25 mg per one g of silver.

2) Preparation of Coating Solution for Intermediate Layer

To 1000 g of polyvinyl alcohol PVA-205 (manufactured by Kuraray Co., Ltd.), 272 g of the 5% by weight pigment-1 dispersion, and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 $mL/m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxy ethanol and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water were dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surface active agent (F-1: potassium salt of N-perfluorooctylsulfonyl-N-propyl alanine), 32 mL of a 2% by weight aqueous solution of a fluorocarbon surface active agent (F-2: polyethylene glycol mono(N-perfluorooctylsulfonyl-N-propyl-2-aminoethyl) ether, [average polymerization degree of ethylene oxide=15]), 3 mL of a 5% by weight solution of a fluorocarbon surface active agent (F-3), 10 mL of a 2% by weight solution of a fluorocarbon surface active agent (F-4), 23 mL of a 5% by weight aqueous solution of aerosol OT (manufactured by American Cyanamid Co.), 4 g of polymethyl methacrylate fine particles (mean particle diameter of 0.7 μm) and 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid was mixed to give a coating solution for the second surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

1-4. Coating of Photothermographic Material-1 to -4

The back surface side of the undercoated support was subjected to simultaneous double coating so that the coating solution for the antihalation layer gives the absorption of 0.3 at 405 nm, and so that the coating solution for the back surface protective layer gives the coating amount of gelatin of 1.7 g/m$^2$, followed by drying to produce a back layer.

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. In this method, the temperature of the coating solution was adjusted to 31° C. for the image forming layer and intermediate layer, to 36° C. for the first layer of the surface protective layer, and to 37° C. for the second layer of the surface protective layer.

The coating amount of each compound for the image forming layer (g/m$^2$) is as follows.

| | |
|---|---|
| Silver behenate | 5.55 |
| Phthalazine compound-1 | 0.19 |
| SBR latex | 9.67 |
| Reducing agent-1 | 0.81 |
| Hydrogen bonding compound-1 | 0.30 |
| Development accelerator-1 | 0.004 |
| Development accelerator-2 | 0.010 |
| Development accelerator-3 | 0.015 |
| Color-tone-adjusting agent-1 | 0.010 |
| Mercapto compound-1 | 0.002 |
| Mercapto compound-2 | 0.012 |
| Silver halide (on the basis of Ag content) | 0.091 |

Conditions for coating and drying are as follows.

Coating was performed at the speed of 160 m/min. The clearance between the leading end of the coating die and the support being 0.10 mm to 0.30 mm, and with the pressure in the vacuum chamber set to be lower than atmospheric pressure by 196 Pa to 882 Pa. The support was decharged by ionic wind.

In the subsequent cooling zone, the coating solution was cooled by wind having the dry-bulb temperature of 10° C. to 20° C. Thereafter, transpotation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C. After heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

Chemical structures of the compounds used in Examples of the invention are shown below.

Tellurium sensitizer C

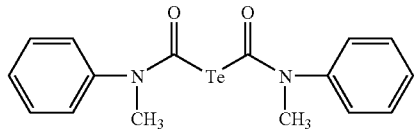

Blue dye-1

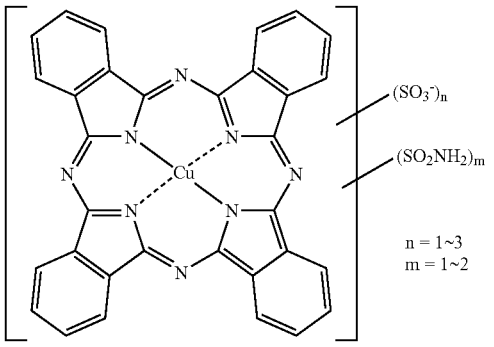

-continued

Ultraviolet absorber-1

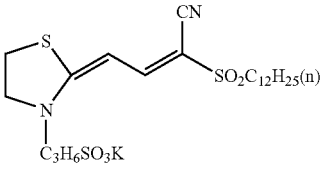

(Reducing agent-1)

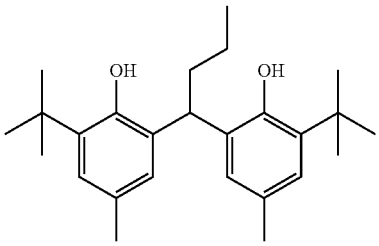

(Hydrogen bonding compound-1)

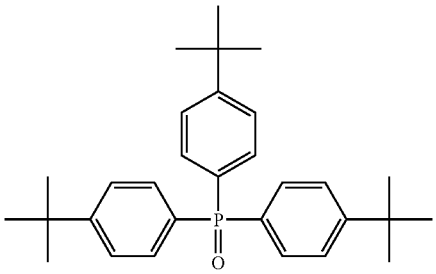

Polyhalogen compound-1

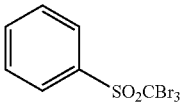

Polyhalogen compound-2

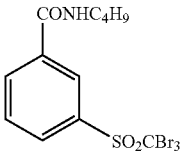

Mercapto compound-1

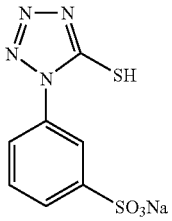

Mercapto compound-2

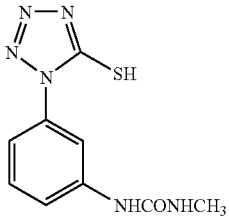

-continued (Phthalazine compound-1)

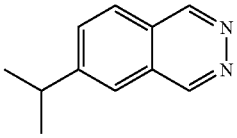

(Development accelerator-1)

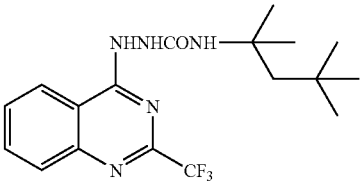

(Development accelerator-2)

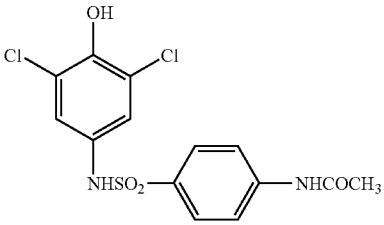

(Development accelerator-3)

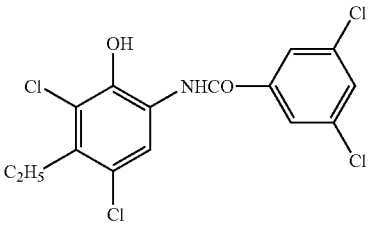

(Color-tone-adjusting agent-1)

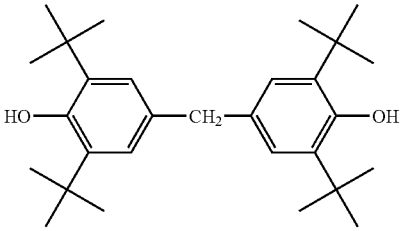

(F-1)

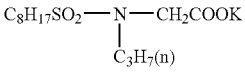

(F-2)

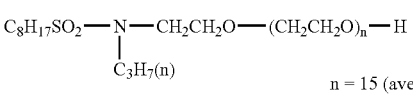

n = 15 (average)

(F-3)

$CF_3(CF_2)_nCH_2CH_2SCH_2CH_2COOLi$ mixture of n = 5 to 11

(F-4)

$CF_3(CF_2)_nCH_2CH_2O(CH_2CH_2O)_mH$ mixture of n = 5 to 11, m = 5 to 15

<<Evaluation on Photothermographic Material-1 to -4>>

Specimens of photothermographic material-1 to -4 obtained as described above were cut into half sizes (43 cm long×35 cm wide), on which evaluation was performed according to the following ways:

(Exposure of Photothermographic Materials)

The samples of photothermographic material-1 to -4 were subjected to an exposure as described below.

A NLMV 3000E laser diode fabricated by Nichia Corporation was mounted as a laser diode beam source in an exposure portion of a Fuji medical dry laser imager FM-DP L and a beam diameter was adjusted to about 100 μm. Exposure of a photothermographic material was performed for $10^{-6}$ sec while setting or altering a photothermographic material surface illumination intensity at 0 mW/mm$^2$ and from 1 mW/mm$^2$ to 1000 mW/mm$^2$. A light-emission wavelength of laser beam was 405 nm.

(Thermal Development of Photothermographic Material)

A photothermographic material having been exposed was subjected to a thermal development as described below.

In the thermal developing portion of a Fuji medical dry laser imager FM-DP L, 4 panel heaters were set to be 112° C.-114° C.-118° C.-121° C. and thermal development was performed so that a total thermal development time amounted to 14 sec by increasing a film transport speed. In data of Table 1, a time from exposure until thermal development was set to 5 sec and in Table 2, thermal development was performed in cases where the thermal development was simultaneously performed with the exposure and where times from exposure until thermal development were set to 5 sec, 15 sec, 30 sec, 60 sec and 90 sec. In the cases of thermal development simultaneously with exposure; and 5 sec and 15 sec, the exposing unit and the thermal developing unit of FM-DP L were taken out to arrange in proper positions to perform an exposure and a thermal development.

(Evaluation on Samples)

1) Sensitivity Evaluation

Densities of obtained images were measured with a densitometer to prepare a characterisitic curve of a density versus the logarithm of an exposure value. A sensitivity is defined as a reciprocal of an exposure value at which an optical density of 3.0 is obtained, and in Table 1, a sensitivity of the photothermographic material-1 is set to 100 and relative sensitivities were shown. A larger relative sensitivity value means a higher sensitivity.

TABLE 1

| Sample No. | Silver halide composition | Sensitivity (5 sec.) |
|---|---|---|
| 1 | $AgBr_{96.5}I_{3.5}$ | 100 |
| 2 | $AgI_{100}$ | 332 |

TABLE 1-continued

| Sample No. | Silver halide composition | Sensitivity (5 sec.) |
|---|---|---|
| 3 | $AgI_{90}Br_{10}$ | 341 |
| 4 | $AgI_{90}Cl_{10}$ | 338 |

As shown in Table 1, in a case where a silver halide with a silver iodide content of 90% by mole or more is used, a good sensitivity is exhibited without adding a sensitizing dye which is photosensitive to an exposure wavelength of 405 nm.

2) Dependency of Time from Exposure until Thermal Development

A sensitivity was set to 100 in a case where a time from exposure until thermal development in each photosensitive material was 5 sec and relative sensitivities of photothermographic materials were expressed in cases where thermal development was simultaneously performed with exposure and where times from exposure to thermal development were set to 15 sec, 30 sec, 60 sec and 90 sec. Samples of the photothermographic materials were stored at 25° C. during a time from exposure until the start of thermal development. With a larger relative sensitivity difference from a sensitivity value at 5 sec, thermal development within a shorter time after exposure can be said to have obtained a higher sensitivity.

Results are shown in Table 2.

TABLE 2

| Sample No. | Silver halide composition | Sensitivity (time from exposure to thermal development) | | | | | |
|---|---|---|---|---|---|---|---|
| | | 90 sec. | 60 sec. | 30 sec. | 15 sec. | 5 sec. | simultaneous with exposure |
| 1 | $AgBr_{96.5}I_{3.5}$ | 98 | 98 | 99 | 100 | 100 | 102 |
| 2 | $AgI_{100}$ | 95 | 97 | 98 | 100 | 100 | 103 |
| 3 | $AgI_{90}Br_{10}$ | 94 | 97 | 99 | 100 | 100 | 102 |
| 4 | $AgI_{90}Cl_{10}$ | 94 | 97 | 98 | 99 | 100 | 103 |

It is found from Table 2 that while in a high silver bromide photothermographic material (Sample No. 1), a fall in sensitivity over elapsed time after exposure is low, in a high silver iodide photothermographic material (Sample Nos. 2 to 4) a fall in sensitivity over elapsed time after exposure is high. Consequently, as for a high silver iodide photothermographic material, it is advantageous, in order to obtain a high sensitivity, to start thermal development within at least 60 sec after exposure, more perferably within 30 sec and still more preferably within 15 sec. If a time from exposure until thermal development exceeds 60 sec, a fall in sensitivity is great and it is found that thermal development is desirably started in the shortest possible time in an aspect of stability of sensitivity as well.

Example 2

<<Preparations of Photothermographic Material-5 to -13>>

Coating solutions for image forming layer were prepared in a similar manner except that in the coating solution for image forming layer-1 to -4, coating amounts of a polyhalogen compound-1 and a polyhalogen compound-2 were set as shown in Table 3, and photothermographic material-5 to -13 were prepared in a similar manner to that in preparation of the photothermographic material-1.

<<Evaluations on Photothermographic Material-5 to -13>>

1) Sensitivity Evaluation

In Table 3, similar to Example 1, sensitivities were expressed as relative values with a sensitivity at a time from exposure until thermal development of 5 sec as 100 for the photothermographic materials in cases where thermal development was simultaneously performed with exposure and where times from exposure to thermal development were set to 15 sec, 30 sec, 60 sec and 90 sec.

2) Fogging Evaluation

A density of a non-developing portion was measured with a Macbeth dentiometer in a case where an image is formed at a time from exposure until thermal development of 5 sec. The lower a density, fogging occurs at a lower level and a photothermographic material is more excellent.

3) Image Stability (Print-out)

Samples on which images were formed at a time from exposure until thermal development of 5 sec were stored for 24 hours under illumination of a fluorescent lamp with an intensity of 1000 Lux, followed by evaluation on an increment ΔDmin in a fog density in a Dmin portion. The smaller the value, a print-out property is more excellent.

While from the results of Table 3, a change percentage in sensitivity increases with a time from exposure until thermal development if an organic polyhalogen compound is added, a conspicuous effect of suppressing fogging of an image is exerted as shown in Table 4 and a change in sensitivity, if any, is on the non-problematical order if a time from exposure till thermal development is within 60 sec.

Example 3

Evaluation was performed similarly to Examples 1 and 2 except that laser beam having light-emission wavelength of 395 nm. In a photothermographic material of the invention, preferable results of a high sensitivity and a small change in sensitivity were obtained similarly to those of the preceding examples.

Example 4

The samples Nos. 1 to 13 of Examples 1 and 2 were exposed and thermal developed with the dry laser imager of FIG. 2. The dry laser imager was properly adjusted to establish a state where a part of the photothermographic material is exposed and in parallel with the exposure, thermal development is started on a part of the sheet having been already exposed and to conduct experiments so as to start thermal development within 5 sec and 15 sec after exposure, thereby having obtained preferable results each with a good sensitivity and without less of a change in sensitivity similarly to the preceding examples. Thermal development was performed setting temperatures of three heat plates to be 107° C.-121° C.-121° C.

TABLE 3

| Sample No. | Silver halide composition | Coating amount of Polyhalogen compound-1 (g/m$^2$) | Coating amount of Polyhalogen compound-2 (g/m$^2$) | Sensitivity (time from exposure to thermal development) 90 sec. | 60 sec. | 30 sec. | 15 sec. | 5 sec. | simultaneous with exposure |
|---|---|---|---|---|---|---|---|---|---|
| 5 | $AgI_{100}$ | 0.02 | 0.06 | 91 | 93 | 94 | 97 | 100 | 104 |
| 6 | | 0.04 | 0.12 | 83 | 90 | 92 | 95 | 100 | 108 |
| 7 | | 0.12 | 0.36 | 78 | 84 | 87 | 92 | 100 | 110 |
| 8 | $AgI_{90}Br_{10}$ | 0.02 | 0.06 | 89 | 93 | 95 | 98 | 100 | 103 |
| 9 | | 0.04 | 0.12 | 82 | 91 | 92 | 96 | 100 | 108 |
| 10 | | 0.12 | 0.36 | 79 | 85 | 90 | 94 | 100 | 110 |
| 11 | $AgI_{90}Cl_{10}$ | 0.02 | 0.06 | 91 | 94 | 96 | 98 | 100 | 103 |
| 12 | | 0.04 | 0.12 | 82 | 89 | 91 | 94 | 100 | 107 |
| 13 | | 0.12 | 0.36 | 79 | 84 | 89 | 96 | 100 | 111 |

TABLE 4

| Sample No. | Silver halide composition | Coating amount of Polyhalogen compound-1 (g/m$^2$) | Coating amount of Polyhalogen compound-2 (g/m$^2$) | Time from exposure to thermal development (sec.) | Fog | Image stability |
|---|---|---|---|---|---|---|
| 2 | $AgI_{100}$ | — | — | 5 | 0.21 | 0.03 |
| 5 | | 0.02 | 0.06 | 5 | 0.18 | 0.01 |
| 6 | | 0.04 | 0.12 | 5 | 0.17 | 0.01 |
| 7 | | 0.12 | 0.36 | 5 | 0.15 | 0.00 |
| 3 | $AgI_{90}Br_{10}$ | — | — | 5 | 0.21 | 0.03 |
| 8 | | 0.02 | 0.06 | 5 | 0.19 | 0.01 |
| 9 | | 0.04 | 0.12 | 5 | 0.16 | 0.01 |
| 10 | | 0.12 | 0.36 | 5 | 0.15 | 0.00 |
| 4 | $AgI_{90}Cl_{10}$ | — | — | 5 | 0.21 | 0.03 |
| 11 | | 0.02 | 0.06 | 5 | 0.19 | 0.01 |
| 12 | | 0.04 | 0.12 | 5 | 0.17 | 0.01 |
| 13 | | 0.12 | 0.36 | 5 | 0.15 | 0.00 |

Similar to the results of Table 2, it is advantageous, in order to obtain a high sensitivity, even in a case where an organic polyhalogen compound is added that in a high silver iodide photothermographic material, thermal development is started within at least 60 sec, more preferably within 30 sec and still more preferably within 15 sec. If a time from exposure until thermal development exceeds 60 sec, a fall in sensitivity is great and it is found that thermal development is desirably started in the shortest possible time in an aspect of stability of sensitivity as well.

What is claimed is:

1. An image forming method with a photothermographic sheet material, comprising imagewise exposing and thermally developing the photothermographic sheet material;

wherein the photothermographic sheet material comprises at least a photosensitive silver halide having an average silver iodide content of 40% by mole or more, a non-photosensitive organic silver salt, a reducing agent and a binder, and a compound expressed by the following formula (H):

$$Q\text{-}(Y)_N\text{—}C(Z_1)(Z_2)X \qquad \text{Formula (H):}$$

wherein Q represents an alkyl group, an aryl group or a hetero ring group; Y represents a divalent linkage group; N represents 0 or 1; $Z_1$ and $Z_2$ each independently represent a halogen atom; and X represents a hydrogen atom or an electron-withdrawing group;

and the thermally developing being started within 60 sec after imagewise exposure of the photothermographic sheet material using an image recording apparatus having an exposure portion and a developing portion and wherein the imagewise exposing and thermal developing comprises imagewise exposing a part of the photothermographic sheet material and simultaneously developing a part of the photothermographic sheet material that has already been imagewise exposed.

2. The image forming method according to claim 1, wherein the photothermographic sheet material is imagewise exposed using a laser.

3. The image forming method according to claim 2, wherein the laser is a laser diode.

4. The image forming method according to claim 3, wherein the laser diode has a light-emission peak intensity in the wavelength of 350 nm to 450 nm.

5. The image forming method according to claim 1, wherein the average silver iodide content of the photosensitive silver halide is 90% by mole or more.

6. The image forming method according to claim 1, wherein the photosensitive silver halide is formed in the absence of the non-photosensitive organic silver salt.

7. The image forming method according to claim 1, wherein the thermal development is started within 30 sec after the imagewise exposure.

8. The image forming method according to claim 1, wherein the thermal development is started within 15 sec after the imagewise exposure.

9. The image forming method according to claim 1, wherein an average grain size of the photosensitive silver halide is 5 nm to 80 nm.

10. The image forming method according to claim 1, wherein an average grain size of the photosensitive silver halide is 5 nm to 30 nm.

11. The image forming method according to claim 1, wherein the photosensitive silver halide is chemically sensitized.

12. The image forming method according to claim 1, comprising a compound that can be one-electron-oxidized to provide a one-electron oxidation product which releases one or more electrons.

13. The image forming method according to claim 1, comprising a compound expressed by the following general formula (R):

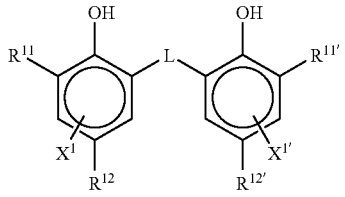

wherein $R^{11}$ and $R^{11'}$ each independently represents an alkyl group having 1 to 20 carbon atoms, $R^{12}$ and $R^{12'}$ each independently represents a hydrogen atom or a group capable of substituting for a hydrogen atom on a benzene ring, L represents a —S— group or a —$CHR^{13}$— group, $R^{13}$ represents a hydrogen atom or an alkyl group having 1 to 20 carbon atoms, and $X^1$ and $X^{1'}$ each independently represents a hydrogen atom or a group capable of substituting for a hydrogen atom on a benzene ring.

14. The image forming method according to claim 1, comprising a developing accelerator.

15. The image forming method according to claim 1, comprising a hydrogen bonding compound.

* * * * *